US007204576B2

(12) United States Patent
Owaki et al.

(10) Patent No.: US 7,204,576 B2
(45) Date of Patent: Apr. 17, 2007

(54) LIQUID EJECTION HEAD AND LIQUID EJECTION APPARATUS USING THE SAME

(75) Inventors: Hiroshige Owaki, Nagano (JP); Munehide Kanaya, Nagano (JP); Takayoshi Katsumura, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 11/342,570

(22) Filed: Jan. 31, 2006

(65) Prior Publication Data

US 2006/0119647 A1 Jun. 8, 2006

Related U.S. Application Data

(62) Division of application No. 10/644,098, filed on Aug. 20, 2003, now Pat. No. 7,044,578.

(30) Foreign Application Priority Data

Aug. 21, 2002 (JP) ..... P2002-240420
Aug. 21, 2002 (JP) ..... P2002-240421
Aug. 21, 2002 (JP) ..... P2002-240422

(51) Int. Cl.
*B41J 2/165* (2006.01)

(52) U.S. Cl. ..... 347/29; 347/27; 347/22

(58) Field of Classification Search ..... 347/22–36, 347/85–89

See application file for complete search history.

(56) References Cited

FOREIGN PATENT DOCUMENTS

JP 2000-190513 A 7/2000
JP 2002-160377 A 6/2002

*Primary Examiner*—Stephen Meier
*Assistant Examiner*—Ly T. Tran
(74) *Attorney, Agent, or Firm*—Sughrue Mion, PLLC

(57) ABSTRACT

A head cover of a recording head includes an opening portion for exposing a nozzle face of the liquid ejection nozzle of a flow path unit, a frame portion provided at a surrounding of the opening portion to cover a peripheral edge portion of the flow path unit to be supported by the mounting face, protective wall portions erected integrally from the frame portion to be formed to cover side faces of the head case, and support portions formed integrally with the protective wall portions and bent from the protective wall portions to extend in surrounding directions for fixing to the head case and the protective wall portion is formed to widen a width thereof toward a side of the support portion.

7 Claims, 16 Drawing Sheets

LIQUID EJECTION HEAD AND LIQUID EJECTION APPARATUS USING THE SAME

This is a divisional of application Ser. No. 10/644,098 filed Aug. 20, 2003 now U.S. Pat. No. 7,044,578. The entire disclosures of the prior application, application Ser. No. 10/644,098 is considered part of the disclosure of the accompanying application and is hereby incorporated by reference.

The present application is based on Japanese Patent Applications No. 2002-240421, 2002-240422 and 2002-240420, the entire contents of which are incorporated herein by reference.

BACKGROUND OF THE INVENTION

1. Field of the Invention

The present invention generally relates to a liquid ejection head for delivering a liquid of a recording head used in an image recording apparatus such as a printer, a colorant ejection head used in fabricating a color filter of a liquid crystal display or the like, an organic EL display, an electrode material ejection head used for forming an electrode of a field emission display (FED) or the like, a living body organic substance ejection head used for fabricating a biochip or the like and a liquid ejection apparatus using the liquid ejection head.

2. Related Art

There is an inkjet printer widely used as a liquid ejection apparatus. The ink jet printer is provided with a recording head as a liquid ejection head for ejecting droplets of ink which is a liquid from a plurality of nozzle openings. The ink droplets are impacted to a surface of recording paper or the like which is a medium by the recording head to thereby print an image, a character or the like.

Such an ink jet printer is provided with a carriage moved relative to the recording paper or the like by a moving unit and the recording head is mounted to the carriage.

FIG. 25 is a schematic sectional view showing a structure assumed for functioning as a recording head mounted to such an ink jet printer and FIG. 26 is a view showing to enlarge a region designated by notation C of FIG. 25.

In the drawings, a recording head 1 is provided with a head case 2 and a circuit board B fixed to an upper face of the head case in the drawing. As shown by FIG. 26, the head case 2 is provided with a base portion 7 spread in a flange-like shape and a front end portion 6 extended integrally from the base portion 7 and projected in a lower direction of the drawing. The head case 2 is formed with a plurality of containing portions H1, H1, H1 arranged in parallel with a longitudinal direction by utilizing an inner portion of the front end portion 6.

As shown by FIG. 25, the containing portions H1, H1, H1 of the head case 2 are respectively fixed with oscillator units 4, 4, 4 as a device for driving nozzles. In details, as shown by FIG. 26, the oscillator unit 4 is provided with an attaching plate or a fixing plate 4*a* fixed to an inner face of the containing portion H1, an oscillator 4*b* arranged by fixing one end thereof to the fixing plate 4*a* and directing a free end thereof in the lower direction and a tape carrier 4*c* comprising a flexible board or the like one end of which is electrically connected to the oscillator 4*b*. Other end of the tape carrier 4*c* is connected to the circuit board B.

Meanwhile, a flow path unit 3 having a laminated layer structure in a plate-like shape is fixed to an end face of the front end portion 6 of the head case 2 and as shown by FIG. 25, the flow path unit 3 is formed with a plurality of nozzle openings 3*a*, 3*a*, 3*a*. Further, ahead cover 5 comprising a metal material in a frame-like shape is arranged from an outer side of the flow path unit 3. The head cover 5 is provided with an opening portion 5*a* for exposing the nozzle openings 3*a*, 3*a*, 3*a* of the flow path unit 3 at a front end thereof, covers a side face of the front end portion 6 of the head case 2 by a protective wall portion 5*b* thereof and fixed to the base portion 7 of the head case 2 by utilizing a support portion 5*c* thereof bent to constitute a flange-like shape.

Thereby, the head cover 5 covers to protect the flow path unit 3 having a fine structure and a side face portion of the head case 2 and shields these parts by a grounding effect by the metal material.

The recording head 1 ejects ink guided to the flow path unit 3 by a means (not illustrated), by applying drive voltage from the circuit board B to the oscillator unit 4 as a driving device from the nozzle opening 3*a* by oscillation of each oscillator 4*b*. Thereby, predetermined printing is carried out on a print face or the like of a medium (not illustrated) of recording paper or the like.

After carrying out the printing, there is a case in which a small amount of ink is adhered to the surrounding or the like of the nozzle opening 3*a* of the flow path unit 3. Therefore, cleaning operation is carried out. As shown in FIG. 25, for example, the cleaning operation is carried out by making a wiping device 8 or the like provided to the ink jet printer relatively approach the recording head 1 as shown by an arrow A1 and moving a wiping face thereof relatively in an arrow A2 direction in a state of being brought into contact with the nozzle opening 3*a* to thereby wipe ink remaining at the surrounding of the nozzle opening 3*a*.

However, according to the recording head 1, there is a case in which the small amount of ink wiped by the cleaning operation remains at a space S1 of FIG. 26. That is, in the cleaning operation, ink may be brought to an inner side of the head cover 5 and stored at an inner space of the space S1 or the like.

That is, the flow path unit 3 is fixed to an end face of the front end portion 6 of the head case 7 by using an adhesive agent and therefore, in order to take an adhering allowance thereof, an outer shape of the flow path unit 3 is necessarily smaller than an outer shape of the end face of the front end portion 6 of the head case 2. Therefore, the space S1 shown by FIG. 26 is necessarily formed at the inner side of the head cover 5.

Therefore, ink invading the inner side of the head cover 5 is stored at the space S1.

The ink stored at the space S1 is brought into a small clearance G1 between the protective wall portion 5*b* of the head cover 5 and a side wall of the front end portion 6 of the head case 2 by the capillary phenomenon, moved in a direction of an arrow A3, spread to a total of the clearance G1 between the protective wall portion 5*b* and the side face of the front end portion 6 of the head case 2 and is held by surface tension.

When the recording head 1 changes its attitude under the state, for example, when the recording head 1 is inclined skewedly in operation of carrying the recording head 1 by a user or the like a phenomenon shown in FIG. 27 is brought about.

FIG. 27 is a schematic perspective view viewing the structure of FIG. 25 from an outer side and an up and down direction is shown to be opposed to that of FIG. 25 for convenience of explanation.

In the drawing, although ink invading the small clearance G1 between the protective wall portions 5*b*, 5*b* contiguous to each other and the side walls of the front end portion 6 of the head case 2 is held in a total of inner faces thereof, when the recording head 1 is inclined such that portions contiguous to the respective protective wall portions 5*b*, 5*b* are disposed on the lower side, ink at the inner faces of the respective wall portions 5*b*, 5*b* is aggregated to the portions contiguous to the respective protective wall portions 5*b*, 5*b* as shown by arrows A10, A10 by its own weight. Therefore, the aggregated ink flows down along the end faces of the respective protective wall portions 5*b*, 5*b* and along directions of arrows A11, A11 and advances to the head case 2. The ink aggregated in this way to increase the weight is liable to flow and may be moved around to a rear face of the base portion 7 in FIG. 27 by conducting the base portion 7 in the flange-like shape and moved to the circuit board B to cause shortcircuit.

That is, according to the constitution shown by FIG. 25 and FIG. 26, the clearance G1 is continuous to the base portion 7 of the head case 2, the clearance between the base portion 7 and the support portion 5*c* of the head cover 5 is extremely small and therefore, the ink moved by the capillary phenomenon is moved up to the base portion 7 of the head case 2. When the recording head 1 changes its attitude under the state, for example, in the case of carrying the recording apparatus 100 by the user, when a main body of the apparatus or the recording head 1 is inclined, the ink stored at the space S1 and continuous to the base portion 7 of the head case 2 may be moved instantaneously to the circuit board B.

SUMMARY OF THE INVENTION

It is an object of the invention to resolve the above-described problem and provide a liquid ejection head capable of effectively avoiding a liquid from effecting adverse influence on a circuit board by restricting invasion and storage of ink between an inner side of a head cover or a protective wall portion of the head cover and a side face portion of a head case and a liquid ejection apparatus using the liquid ejection head.

(1) According to the invention, the above-described object is achieved by a liquid ejection head which is a liquid ejection head comprising a flow path unit for forming a nozzle for ejecting a liquid and a pressure chamber communicating with the nozzle for bringing about a change in a pressure by a driving device, the flow path unit being brought into contact with a head case and protected by a head cover, the head cover comprising an opening portion for exposing a nozzle face of the nozzle of the flow path unit and a frame portion provided at a surrounding of the opening portion for covering a peripheral edge portion of the flow path unit to be supported by the head case, a protective wall portion erected integrally from the frame portion and formed to cover a side face of the head case, and a support portion formed integrally with the protective wall portion and bent from the protective wall portion to extend to a surrounding direction for fixing to the head case, wherein a liquid restricting portion for restricting invasion and storage of liquid between the head case and head cover is formed on the head case.

(2) Specifically, in the invention, the liquid restricting portion may be provided as a structure that the protective wall portion is formed to widen a width of a clearance between the protective wall portion and the head case toward a side of the support portion.

According to the above constitution, the head cover covers to protect the peripheral edge of the flow path unit fixed to the head case by the frame portion. Further, the head cover covers to protect the side face of the head case by the protective wall portion, the support portion of the head cover is fixed to a base portion of the head case and therefore, the flow path unit and the side face of the head case can firmly be protected. According to the structure, the protective wall portion of the head cover is formed such that the width is widened to the side of the support portion of the head case. Therefore, an interval between the protective wall portion of the head cover and the side face of the head case is made to be widened. Therefore, the liquid brought from the opening portion of the head cover to the inner side is not guided in a direction of the support portion of the head case by the capillary phenomenon and therefore, adverse influence can effectively be prevented from being effected on a part present on the side of the support portion of the head case, for example, an electric constitution of a circuit board or the like of the recording head.

(3) The invention is characterized in that the clearance widening portion of the protective wall portion of the head cover for widening the width includes a stepped portion at a portion of the protective wall portion.

According to the above constitution, when the clearance widening portion is constituted to widen the width by forming the stepped portion, the interval between the protective wall portion of the head cover and the side face of the head case is widened by a large amount with the stepped portion as a boundary and therefore, the liquid brought from the opening portion of the head cover to the inner side is not guided in the direction of the support portion of the head case by the capillary phenomenon with the stepped portion as the boundary.

Further, the stepped portion can easily be formed by pressing or bending the head cover.

(4) The invention is characterized in that the clearance widening portion of the protective wall portion of the head cover for widening the width is formed in a taper shape gradually widening toward the side of the support portion.

According to the above constitution, the clearance widening portion is formed in the taper shape gradually widening toward the side of the support portion and therefore, the interval between the protective wall portion of the head cover and the side face of the head case is gradually widened by a large amount. Therefore, the liquid brought from the opening portion of the head cover to the inner side is not guided by the capillary phenomenon in the direction of support portion of the head case at a position of a size of the interval constituting a limit of operating the capillary phenomenon.

Further, the taper shape can easily be formed by pressing or bending the head cover.

(5) The invention is characterized in that at a region between a base portion in a shape of a flange and a front end portion of the head case, a groove portion is formed to surround a surrounding of the front end portion.

According to the above constitution, even when the liquid brought from the opening portion of the head cover to be inner side is guided in the direction of the support portion of the head case, the liquid is contained in the groove portion at a region of a vicinity of a root of the base portion in the flange-like shape of the head case and the liquid can effectively prevented from moving around the base portion and effecting adverse influence on a part disposed frontward therefrom, for example, an electric constitution of the circuit board of the recording head or the like.

(6) The invention is characterized in that the protective wall portion of the head cover is formed with an opening portion.

According to the above constitution, at a region of forming the opening portion to the protective wall portion of the head cover, an interval of holding the liquid is not present between the protective wall portion of the head-cover and the side plate of the head case and therefore, the liquid is not conducted.

(7) The invention is characterized in that the support portion of the head cover is formed with an opening portion.

According to the above constitution, at a region of forming the opening portion at the support portion of the head cover, an interval of holding the liquid is not present between the support portion of the head cover and the base portion of the head case and therefore, the liquid is not conducted frontward from t base portion of the head case.

(8) The invention is characterized in that the clearance widening portion in the taper shape of the head cover starts from a location apart from the frame portion to the side of the support portion by a predetermined distance.

According to the above constitution, at an interval from the frame portion of the head cover by the predetermined distance, the protective wall portion functions as a positioning device in attaching the head cover to the head case by being brought into close contact with the side face of the head case and integrating operability is promoted.

(9) The invention is characterized in that an opening angle of the clearance widening portion in the taper shape of the head cover is set to fall in a range of from 7 degrees to 10 degrees.

According to the above constitution, when the opening angle of the clearance widening portion in the taper shape of the head cover is less than 7 degrees, there is a drawback that capillary force is exerted to a liquid of ink or the like invading between the head cover and the head case. Further, when the opening angle of the clearance widening portion in the taper shape of the head cover exceeds 10 degrees, there is a drawback of enlarging the head. When the opening angle of the clearance widening portion in the taper shape of the head cover falls in the range of from 7 degrees through 10 degrees, there is achieved an advantage of capable of preventing a liquid of ink or the like invading between the head cover and the head case from exerting the capillary force without enlarging the head.

(10) Further, according to the invention, the above-described object is achieved by a liquid ejection head comprising a flow path unit for forming a nozzle for ejecting a liquid and a pressure chamber communicating with the nozzle for bringing about a change in a pressure by a driving device, the flow path unit being brought into contact with a head case and protected by a head cover, the head cover comprising an opening portion for exposing a nozzle face of the nozzle of the flow path unit and a frame portion provided at a surrounding of the opening portion for covering a peripheral edge portion of the flow path unit to be supported by the head case, a protective wall portion erected integrally from the frame portion and formed to cover a side face of the head case, and a support portion formed integrally with the protective wall portion and bent from the protective wall portion to extend to a surrounding direction for fixing to the head case, wherein a corresponding portion of the head case fixed with the support portion includes a projected portion projected to a side of the support portion.

According to the above constitution, the head cover covers to protect the peripheral edge of the flow path unit fixed to the head case by the frame portion. Further, the head cover covers to protect the side face of the head case by the protective wall portion, the support portion of the head cover is fixed to the base portion of the head case and therefore, the flow path unit and the side face of the head case can firmly be protected. In such a structure, the corresponding portion of the head case fixed with the support portion includes the projected portion projected to the side of the support portion. Therefore, even when the liquid brought from the opening portion of the head cover to the inner side is guided to the base portion of the head case, the projected portion constitutes a spacer between the base portion of the head case and the support portion of the head cover to form a comparatively large interval. Therefore, the liquid cannot be conducted through the interval by the capillary phenomenon and the liquid can effectively be prevented from effecting adverse influence on a part present frontward from the base portion of the head case, for example, an electric constitution of the circuit board of the recording head or the like.

(11) Further, according to the invention, the above-described object is achieved by a liquid ejection apparatus which is a liquid ejection apparatus comprising a liquid ejection head comprising a flow path unit for forming a nozzle for ejecting a liquid and a pressure chamber communicating with the nozzle for bringing about a change in a pressure by a driving device, the flow path unit being brought into contact with a head case and protected by a head cover and a device for moving the liquid ejection head relative to an object of ejecting the liquid, the head cover of the liquid ejection head comprising an opening portion for exposing a nozzle face of the nozzle of the flow path unit and a frame portion provided at a surrounding of the opening portion for covering a peripheral edge portion of the flow path unit to be supported by the mounting face, a protective wall portion erected integrally from the frame portion for covering a side face of the head case, and a support portion formed integrally with the protective wall portion and bent from the protective wall portion to extend in a surrounding direction for fixing to the head case, wherein a liquid restricting portion for restricting invasion and storage of liquid between the head case and head cover is formed on the head case.

(12) More specifically, in the liquid ejection apparatus of the invention, the liquid restricting portion is provided as a structure that the protective wall portion is formed to widen a width of a clearance between the protective wall portion and the head case toward a side of the support portion.

(13) Further, according to the invention, the above-described object is achieved by a liquid ejection apparatus which is a liquid ejection apparatus comprising a liquid ejection head comprising a flow path unit for forming a nozzle for ejecting a liquid and a pressure chamber communicating with the nozzle for bringing about a change in a pressure by a driving device, the flow path unit being brought into contact with a head case and protected by a head cover and a device for moving the liquid ejection head relative to an object of ejecting the liquid, the head cover of the liquid ejection head comprising an opening portion for exposing a nozzle face of the nozzle of the flow path unit and a frame portion provided at a surrounding of the opening portion for covering a peripheral edge portion of the flow path unit to be supported by the mounting face, a protective wall portion erected integrally from the frame portion for covering a side face of the head case, and a support portion formed integrally with the protective wall portion and bent from the protective wall portion to extend in a surrounding direction for fixing to the head case, wherein a corresponding portion of the head case fixed with the support portion includes a projected portion projected to a side of the support portion.

(14) According to the invention, a plurality of the protection wall may provided as said at least one protection wall, and the liquid restricting portion may be provided as a structure that an end face in a direction of a width of each of the protective wall portions includes a chamfered portion chamfered so as to reduce a width of each of the protective wall portions along a direction of being apart from the frame portion.

According to the above constitution, the head cover covers to protect the peripheral edge of the flow path unit fixed to the head case by the frame portion. Further, the head cover covers to protect the side face of the head case by the protective wall portion, the support portion of the head cover is fixed to the base portion of the head case and therefore, the flow path unit and the side face of the head case can firmly be protected. In such a structure, the end face in the direction of the width of each of the protective wall portions includes the chamfered portion chamfered to reduce the width of each of the protective wall portions along the direction of being apart from the frame portion. Therefore, there is constituted a structure in which the respective end faces of the protective wall portions contiguous to each other are not butted each other. Therefore, even when the head changes its attitude, there is hardly a location of a corner at which the liquid of ink or the like is aggregated and therefore, the aggregated ink is dropped by its own weight and is effectively prevented from moving to other part.

(15) The invention is characterized in that a width of an interval between the protective wall portions opposed to each other in the plurality of protective wall portions is formed to widen toward sides of the support portions.

According to the above constitution, there is constructed a constitution in which the width of the interval between the protective wall portions opposed to each other is widened and therefore, a clearance between the protective wall portion and the side face of the head case is widened. Therefore, the liquid brought from the opening portion of the head cover to the inner side is not guided by the capillary phenomenon in the direction of the support portion of the head case and therefore, the liquid can effectively be prevented from effecting adverse influence on a part present on the side of the support portion of the head case, for example, an electric constitution of the circuit board of the recording head or the like.

(16) The invention is characterized in that the widths of the interval widening portions of the protective wall portions opposed to each other of the head cover for widening the widths are widened by providing stepped portions at portions of the protective wall portions.

According to the above constitution, when there is constructed a constitution in which the width of the interval widening portion is widened by forming the stepped portion, the interval between the protective wall portion of the head cover and the side face of the head case is widened by a large amount with the stepped portion as a boundary and therefore, the liquid brought from the opening portion of the head cover to the inner side is not guided by the capillary phenomenon in the direction of the support portion of the head case with the stepped portion as a boundary.

Further, such a stepped portion can easily be formed by pressing or bending the head cover.

(17) The invention is characterized in that the interval widening portions of the protective wall portions opposed to each other of the head cover for widening the widths are formed in a taper shape gradually widening toward the sides of the support portions.

According to the above constitution, the interval widening portion is formed in the taper shape gradually widening toward the side of the support portion and therefore, the interval between the protective wall portion of the head cover and the side face of the head case is gradually widened by a large amount. Therefore, the liquid brought from the opening portion of the head cover to the inner side is not guided by the capillary phenomenon in the direction of the support portion of the head case at a position of a size of the interval constituting a limit of operating the capillary phenomenon.

Further, such a taper shape can easily be formed by pressing or bending the head cover.

(18) The invention is characterized in that the interval widening portion in the taper shape of the head cover is started from a location apart from the frame portion to the side of the support portion by a predetermined distance.

According to the above constitution, at an interval from the frame portion of the head cover by the predetermined distance, the protective wall portion functions as a positioning device in attaching the head cover to the front end portion of the head case by being brought into close contact with the side face of the head case and integrating operability is promoted.

(19) The invention is characterized in that the plurality of support portions integral with the plurality of protective wall portions are constructed by a constitution of being fixed to the head case by screwing and the chamfered portions are formed at the end faces of the protective wall portions including the support portions to be screwed contiguous to each other.

According to the above constitution, when the liquid of ink or the like is guided to the screwed support portion, the liquid is liable to invade a side of other part by conducting the screwed portion. Therefore, when the chamfered portions are provided at the contiguous end faces of the protective wall portions having the screwed support portions, the liquid conducted to screwed portion can effectively be prevented from invading the side of the other part.

(20) Further, according to the invention, the above-described object is achieved by a liquid ejection apparatus in which a plurality of the protection wall are provided as said at least one protection wall, and the liquid restricting portion is provided as a structure that an end face in a direction of a width of each of the protective wall portions includes a chamfered portion chamfered so as to reduce a width of each of the protective wall portions along a direction of being apart from the frame portion.

(21) In another aspect of the invention, the liquid restricting portion may be provided as a structure that a notch portion is, formed at a vicinity of a boundary between the frame portion and the protective wall portion.

According to the invention, the head cover covers to protect the peripheral edge of the flow path unit fixed to the end face of the front end portion of the head case by the frame portion. Further, the head cover covers to protect the side face of the head case by the protective wall portion, the support portion of the head cover is fixed to the base portion of the head case and therefore, the flow path unit and the side face of the head case can firmly be protected. In such a structure, the notch portion is formed at the vicinity of the boundary between the frame portion and the protective wall portion of the head cover. Therefore, the liquid of ink or the like invading the inner side of the head cover comes to outside from the space of the inner side the head cover via the notch portion and therefore, the liquid of ink or the like can effectively be prevented from being stored in the space on the inner side of the head cover. Further, the liquid of ink or the like can be avoided from passing on the inner side of the head cover to move to other part to thereby effect adverse influence.

(22) The invention is characterized in that the notch portion is provided at a position which does not interfere with a wiping direction of a wiping device in an operation of cleaning the liquid ejection head.

According to the above constitution, the notch portion is provided to avoid the position of interfering with the wiping direction of the wiping device and therefore, the wiping device formed by a comparatively soft material is prevented from damaging the notch portion by being brought into contact therewith owing to the cleaning operation.

(23) The invention is characterized in that the frame portion is constituted by a shape of surrounding a peripheral edge of the front end portion of the head case, the protective wall portion is constituted by a plurality of protective wall portions to be divided by a plural number from the frame portion to erect and the notch portion is divided by a plural number in a corresponding one of the protective wall portions on which the notch portion is provided.

According to the above constitution, the notch portion is divided by the plural number such that a single large notch portion is not constituted and therefore, strength of respective portions of the head cover starting from the protective wall portion and the frame portion is not deteriorated by that amount.

(24) The invention is characterized in that at least one notch portion of the plurality of notch portions is provided at a position in correspondence with a guide member on a side of a covering member in mounting the covering member for covering the nozzle face when printing is not carried out.

According to the above constitution, the notch portion can not only prevent the liquid of ink or the like from being stored on the inner side of the head cover but can function as a guiding device in mounting the covering member which needs fine positioning.

(25) The invention is characterized in that a plurality of protective wall portions are provided as the protective wall portion and at lease one of the protective wall portions of is not provided with the support portion, the protective wall portion which is not provided with the support portion includes a larger number of the notch portions than a number of the notch portions of another protective wall portion which is provided with the support portion.

According to the above constitution, by providing a number of the notch portions at positions of the protective wall portion which is not provided with the support portion, the notch portion having an effective area or size can be provided without deteriorating the strength of fixing the head cover to the head case.

(26) According to the invention, in a liquid ejection apparatus, the liquid restricting portion is provided as a structure that a notch portion is formed at a vicinity of a boundary between the frame portion and the protective wall portion.

DETAILED DESCRIPTION OF THE PREFERRED EMBODIMENTS

Preferable embodiments of the invention will be explained in details in reference to the attached drawings as follows.

Further, although the embodiments described below are preferable specific examples of the invention and therefore, attached with various limitations preferable technically, a range of the invention is not limited to the embodiments so far as there is not a description stating to particularly limit the invention in the following explanation.

Figure 1:
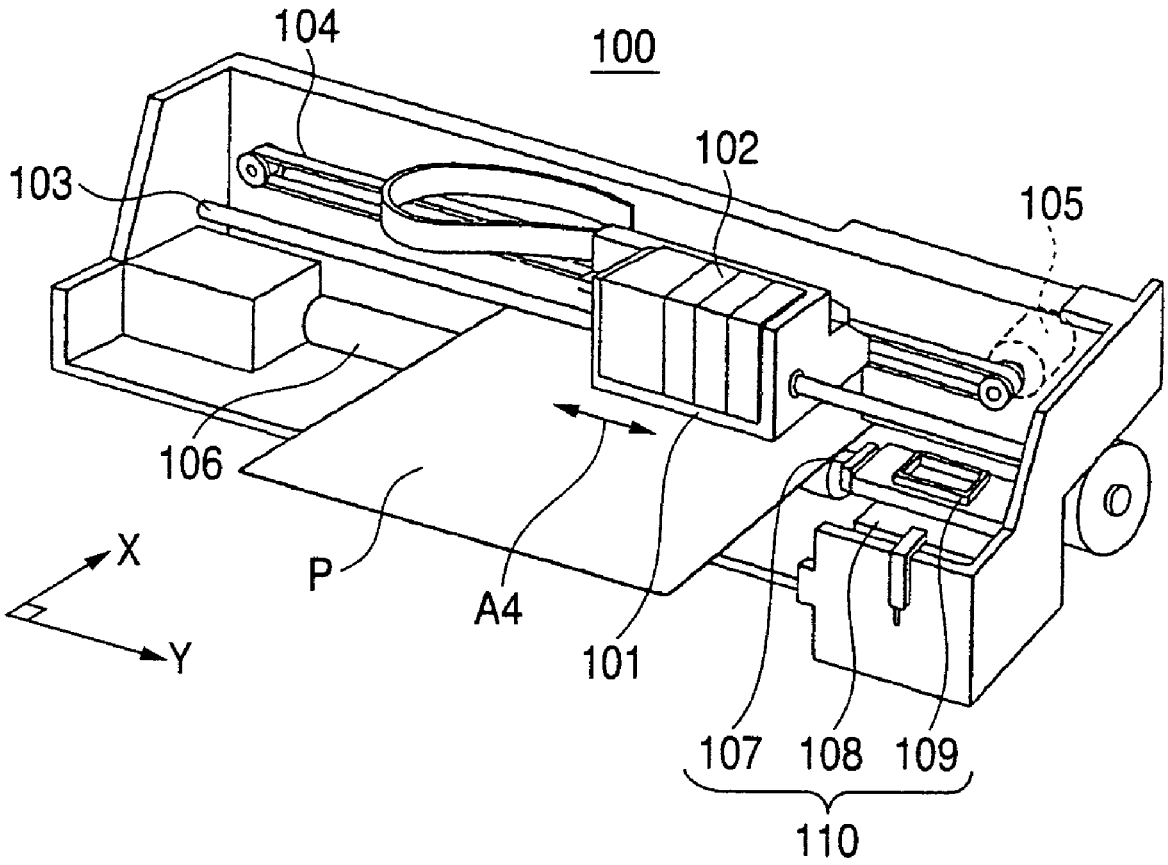
FIG. 1 is a schematic constitution view showing an example of a total structure of an ink jet recording apparatus as a preferable embodiment of a liquid ejection apparatus of the invention.

FIG. 1 is a schematic constitution view showing an example of a total structure of an ink jet recording apparatus as a preferable embodiment of a liquid ejection apparatus of the invention.

In the drawing, an ink jet recording apparatus (hereinafter, referred to as "recording apparatus") 100 is an apparatus of carrying out printing by ejecting ink onto a surface of a medium P of paper or the like.

For that purpose, a carriage 101 mounted with an ink cartridge 102 is arranged to be opposed to a print face of the medium P. The carriage 101 is mounted with the ink cartridge 102 and a recording head, mentioned later. A front end portion of a case of the recording head for forming a nozzle is directed to the print face of the medium P. The carriage 101 is connected with a carriage moving unit 104 of a timing belt or the like, the timing belt 104 as the moving unit is driven by a driving device 105 of a timing motor or the like, guided by a guiding device 103 and moved, for example, in a direction of an arrow A4 coinciding with a direction of a platen 106. In the following drawings, in the case of indicating directions by using notations X and Y, the direction of the arrow A4 is designated by notation Y as a main scanning direction and a direction orthogonal to the main scanning direction is designated by an arrow X as a sub scanning direction.

A home position (nonprinting region) which is a non-printing region of the recording apparatus 100 is arranged with a wiping device 107 for wiping a nozzle face of the recording head (mentioned later) mounted to the carriage 101. The wiping device 107 wipes the face of the recording head forming the nozzles by moving relative to a direction of moving the carriage 101. Therefore, a material and a mode suitable for wiping having elasticity to some degree of rubber of the like are selected for the wiping device 107.

Further, contiguous to the wiping device 107, a cover member (cap) 109 is arranged to the home position or a vicinity thereof. The cover member 109 is formed by a mode capable of containing a front end portion of the recording head, mentioned later, for cleaning ink by adsorbing ink by negative pressure by covering the front end portion of the recording head to constitute a hermetically closed space at inside thereof. The covering member 109 is connected with a pump unit 108 to be able to form the negative pressure in the hermetically closed space. Therefore, a cleaning device 110 of the recording head is formed as a whole by adopting the pump unit 108 and the covering member 109 and the wiping device 107 in addition thereto.

Figure 2:
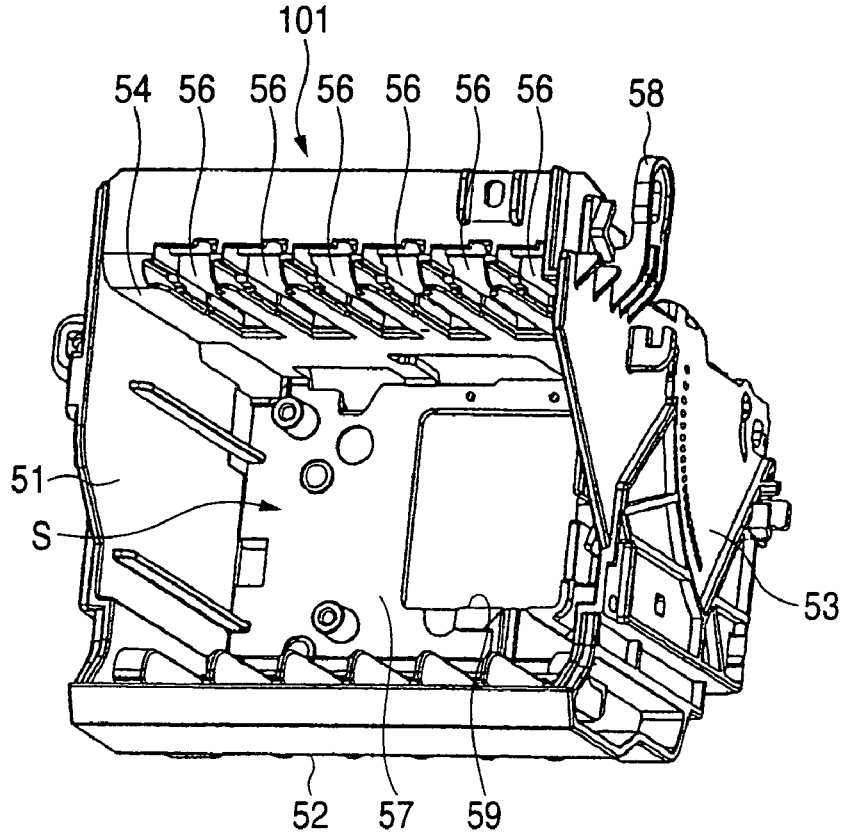
FIG. 2 is a perspective view showing an example of a specific constitution of a carriage 101 of the recording apparatus 100 of FIG. 1.
Figure 3:
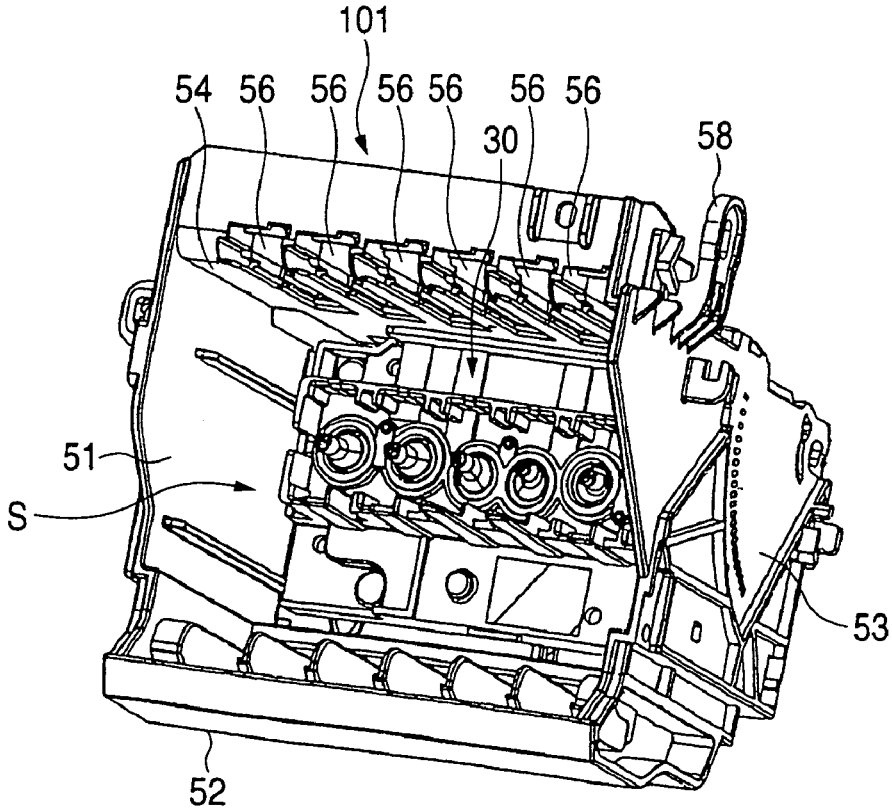
FIG. 3 is a view showing a state of the carriage 101 attached with a recording head 30 of the recording apparatus 100 of FIG. 1.

FIG. 2 and FIG. 3 are specific views showing a specific constitution example of the carriage 101 of the recording apparatus 100 explained in reference to FIG. 1, FIG. 2 shows a state of the carriage 101 which is not attached with the recording head 30 and FIG. 3 shows a state of the carriage 101 attached with the recording head 30.

In FIG. 2, the carriage 101 is a containing member in a box-like shape having an inner space S surrounded by four side faces and a bottom portion by providing a front side wall 52, a rear sidewall 54, and two sidewalls 51 and 53 and providing a bottom plate 57 and opening an upper side thereof.

The rear side wall 54 of the carriage 101 is formed with slits 56, 56 . . . extended in a vertical direction in parallel with each other. The slits 56, 56 . . . are provided in correspondence with a number of respective color inks of the ink cartridge 102 (refer to FIG. 1) contained in the carriage 101 and electrodes, not illustrated, are provided to project from the slits 56, 56 . . . to the inner space S and connected to terminals (not illustrated) of a storing device of the ink cartridge 102.

The bottom plate 57 of the carriage 101 is formed with a through hole 59 in, for example, a rectangular shape as shown by FIG. 2 and at inside of the inner space S of the carriage 101, in a state of attaching the recording head 30 as shown by FIG. 3, a front end portion of the recording head 30 formed with the nozzle is exposed from the bottom plate 57.

Although the carriage 101 includes a portion connected to the guiding device 103 of the recording apparatus 100 of FIG. 1 and a portion formed separately therefrom for inserting the recording head 30, the ink cartridge 102 and the like, these may be integrally formed.

Figure 4:
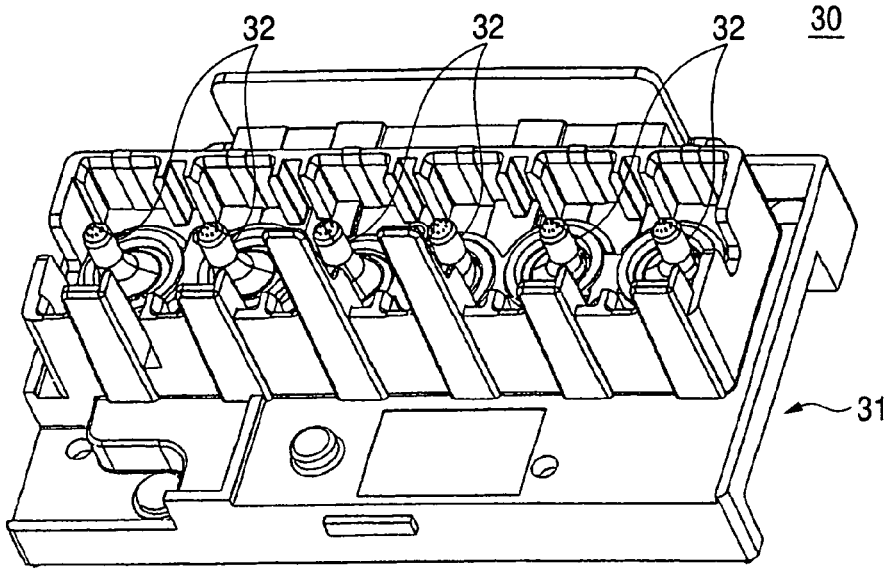
FIG. 4 is a schematic perspective view of the recording head 30 as an embodiment of a liquid ejection head according to the invention contained in the carriage 101 of the recording apparatus 100 of FIG. 1.
Figure 5:
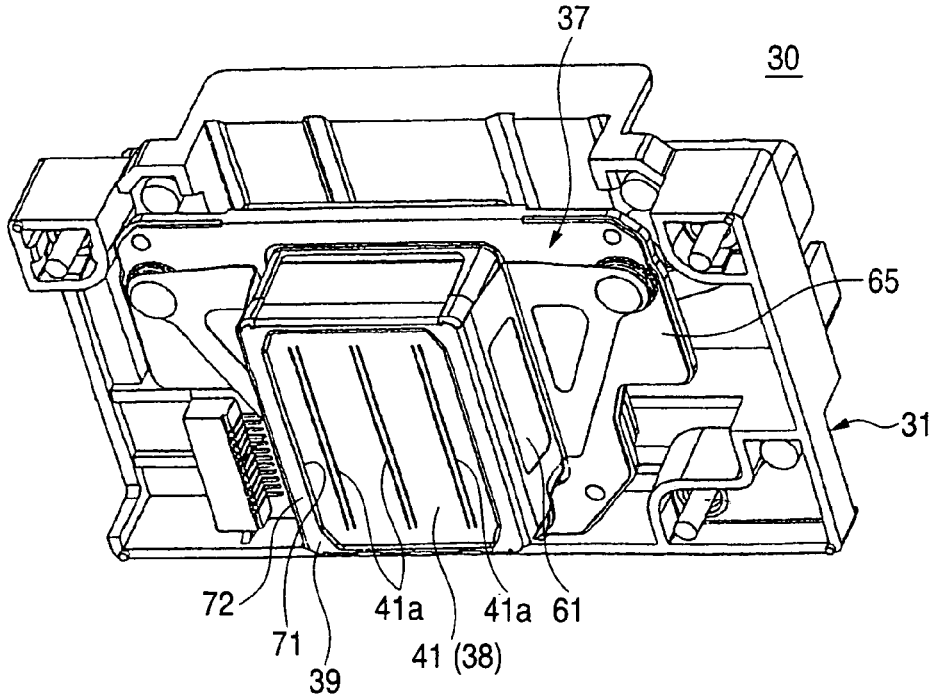
FIG. 5 is a schematic perspective view of the recording head 30 as the embodiment of the liquid ejection head according to the invention contained in the carriage 101 of the recording apparatus 100 of FIG. 1.
Figure 6:
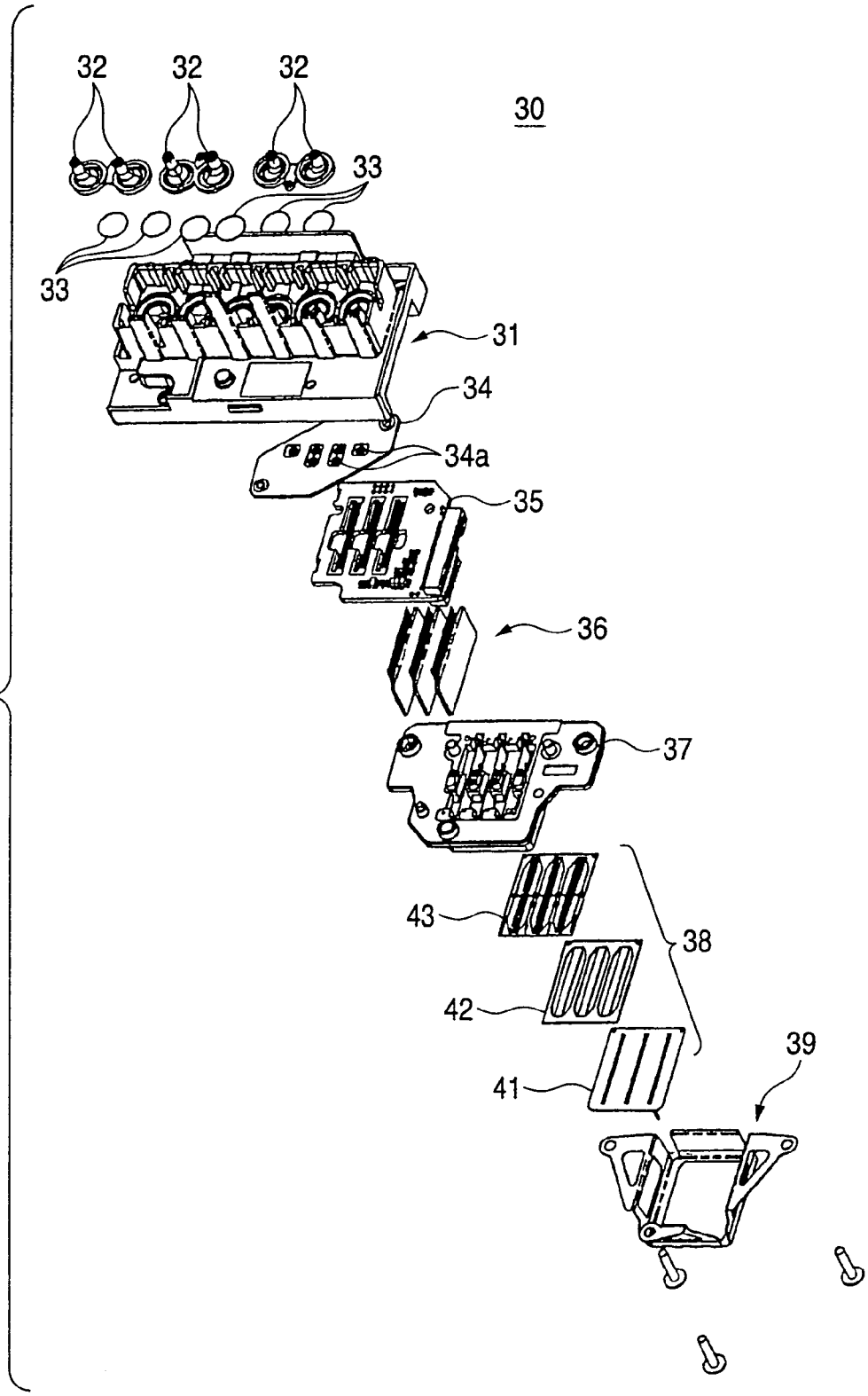
FIG. 6 is an exploded perspective view of the recording head 30 of the recording apparatus 100 of FIG. 1.

FIG. 4 and FIG. 5 are schematic perspective views of the recording head 30 as the embodiment of the liquid ejection head according to the invention contained in the carriage 101 and FIG. 6 is an exploded perspective view of the recording head 30.

As shown by the drawings, the recording head 30 includes a cartridge base (hereinafter, referred to as "base") 31 for attaching various parts, mentioned later. The base 31 is a support base made of, for example, a synthetic resin as a whole and is provided with a plurality of sections as shown by FIG. 6 at one face thereof (upper face in the drawing). The sections are provided in correspondence with a number of respective color inks of the ink cartridge 102 (refer to FIG. 1). The respective sections are respectively attached with ink supply pins 32 . . . via filters 33 . . . as illustrated.

Other face of the base 31 is attached with a circuit board 35 via a sheet member 34 for constituting a packing. The sheet member 34 is formed with a through hole 34*a* for supplying ink. The circuit board 35 is provided with, for example, a drive circuit or the like for driving an ejection nozzle of ink, a connector for connecting to a main body side, a through hole in correspondence with the through hole 34*a* for supplying ink of the sheet member 34 and the like.

Further, the recording head 30 is provided with an oscillator unit 36 having a plurality of piezoelectric oscillators and a head case 37 attached with the oscillator units 36. The oscillator unit 36 is fixed in parallel with the plurality of piezoelectric oscillators at a fixed plate and supplied with drive voltage from the circuit board 35 via a tape carrier, not illustrated. By driving the oscillator unit 36, ink is delivered from the nozzle formed at a flow path unit 38.

For that purpose, the tape carrier, not illustrated, of the oscillator unit 36 is inserted into a through hole of the circuit board 35, bent, thereafter connected to the circuit board 35 by soldering and connected to the connector or the like.

Figure 7:
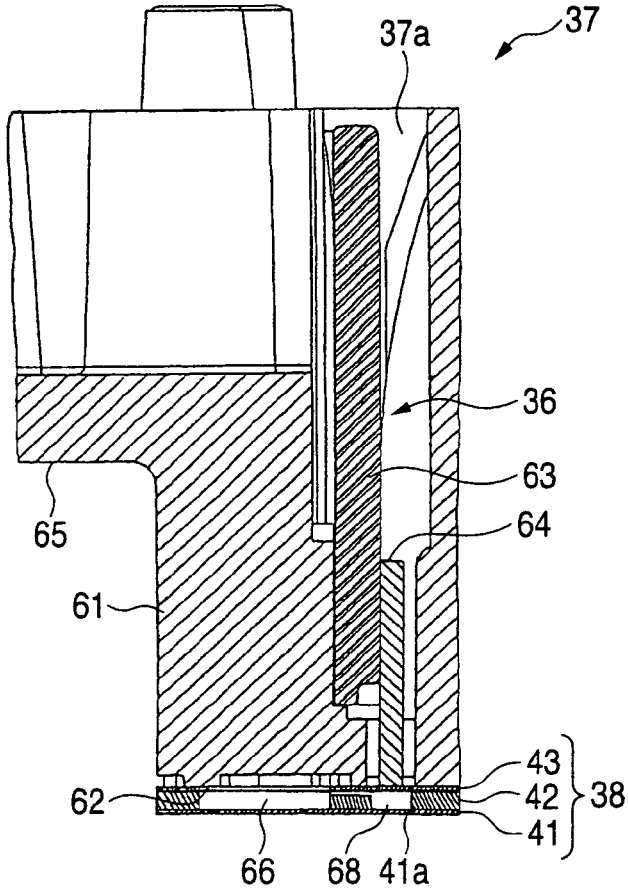
FIG. 7 is a schematic sectional view of a head case 37 of the recording head 30 of the recording apparatus 100 of FIG. 1.

Further, as shown by FIG. 7, the oscillator unit 36 is inserted into a containing portion 37*a* of the head case 37.

As shown by FIG. 5, the head case 37 is fixed to the base 31 and the casing for containing the above-described oscillator unit 36. The head case 37 includes a base portion 65 having a mode spread in, for example, a flange-like shape and a front end portion 61 in a block-like shape comprising substantially a parallelepiped projected in the lower direction in FIG. 7 integrally from the base portion 65. The base portion 65 of the head case 37 is spread in, for example, a flange-like shape and functions for fixing a support portion of a head cover 39, mentioned later.

A flow path unit 38 is brought into contact with an end face 62 (mounting plate) of the front end portion 61 of the head case 37 and is fixed by, for example, an adhesive agent or the like.

The flow path unit 38 is formed by successively laminating a nozzle plate 41, a flow path forming board 42 and an elastic plate 43 from a lower side to an upper side of FIG. 7 to integrate to fix by an adhesive agent or the like.

The nozzle plate 41 comprises a thin plate made of, for example, stainless steel and formed with small nozzle openings 41*a* in a shape of a row at a pitch in correspondence with a dot forming density of the printer.

Figure 8:
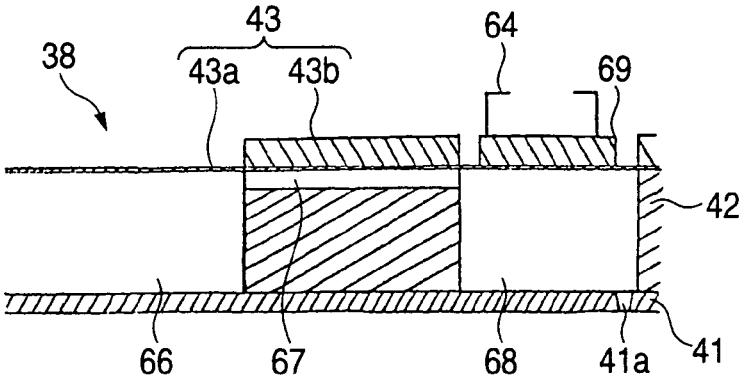
FIG. 8 is a sectional view enlarging a portion of a flow path unit 38 shown in FIG. 7.

FIG. 8 is a sectional view enlarging the flow path unit 38 of FIG. 7. In the drawing, the flow path forming board 42 forms a flowpath for delivering ink guided from the ink cartridge to each nozzle opening 41*a* of the nozzle plate 41 and is formed by subjecting a silicon wafer to an etching treatment. The flow path forming board 42 is formed with a pressure chamber 68 comprising a plurality of partitioned regions communicating with the respective nozzle openings 41*a* of the nozzle plate 41 in correspondence therewith, a common ink chamber 66 for storing ink, an ink supply port 67 in a groove-like shape for communicating the common ink chamber and the above-described pressure chamber and the like.

The elastic plate 43 is arranged to dispose on the flow path forming board 42 and is formed by a plate member laminated with a support plate 43*b* made of a metal of, for example, stainless steel or the like on an elastic film 43*a* of, for example, polyphenylene sulphide (PPS).

The elastic plate 43 is made to overlap the flow path forming board 42 and is fixed in a state of closing an opening portion on an upper side in FIG. 7 of the pressure chamber 68, the common ink chamber 66 and the ink supply port 67 of the flow path forming board 42. Further, at a portion of the elastic plate 43 in correspondence with the pressure chamber 68, the support plate 43*b* made of a metal is removed in a ring-like shape to leave an island portion 69 on an inner side thereof and the island portion 69 is fixed with a front end of each oscillator 64 of the oscillator unit 36. Thereby, movement of the oscillator 64 is transmitted to the pressure chamber 68 via the island portion 69. Further, a portion of the elastic plate 43 in correspondence with the ink supply port 67 maintains a sectional area of the flow path of the groove for forming the ink supply port 67 by leaving the support plate 43*b* made of a metal. Further, at a region of the elastic plate 43 in correspondence with the common ink chamber 66, the support plate 43*b* made of a metal is removed to leave only the elastic film 43*a* to operate to provide compliance by following movement by increasing and reducing ink at inside of the common ink chamber 66.

The head cover 39 of FIG. 6 is a protective member made of a metal for holding the flow path unit 38 from an outer side of the nozzle plate 41 in a state of surrounding a peripheral edge portion thereof and in a state of bringing the flow path unit 38 into contact with the front end portion 61 of the head case 37 as shown by FIG. 5.

The recording head 30 is constituted as described above, the respective ink supply pins 32 . . . fixed to the base 31 guide corresponding respective color inks from respective cartridges to the side of the base 31 and the inks are guided to the flow path unit 38 held by the head case 37 via the ink supplying through holes 34*a* or the like of the sheet member 34. At the flow path unit 38, ink temporarily stored at the common ink chamber 66 of the flow path forming board 42 passes the ink supply port 67 of FIG. 8 and is ejected from the nozzle opening 41*a* of the nozzle plate 41 via the pressure chamber 68 in accordance with movement of the oscillator 64 of the oscillator unit 36. Thereby, ink is impacted to the print face of the medium P of FIG. 1 and printing is carried out in this way in a shape of a line on the print face of the medium P by feeding the carriage 101 in the direction of the arrow A4.

Figure 9:
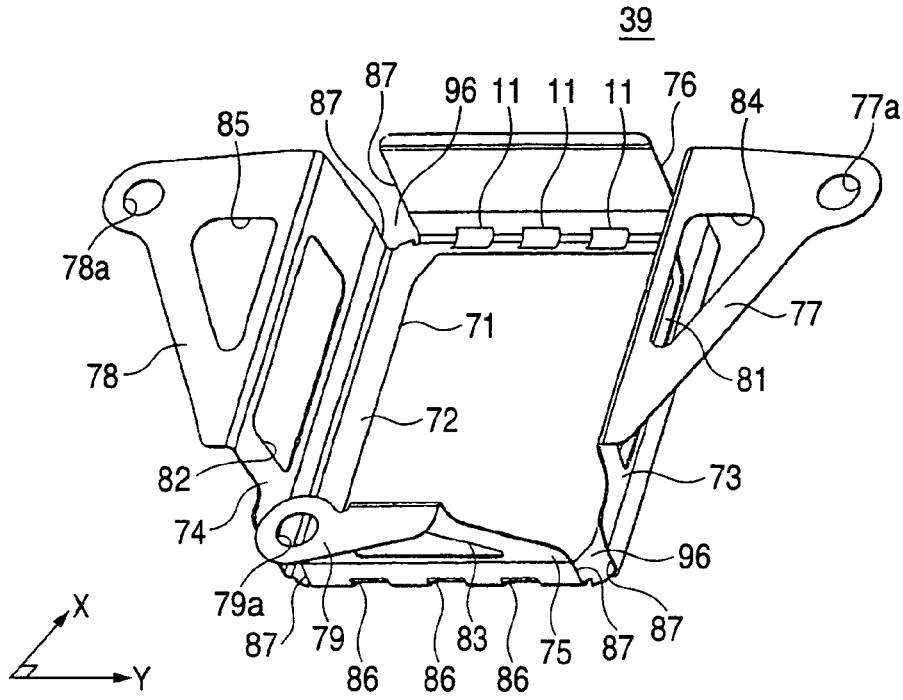
FIG. 9 is a schematic perspective view of a head cover 39 of FIG. 6.
Figure 10:
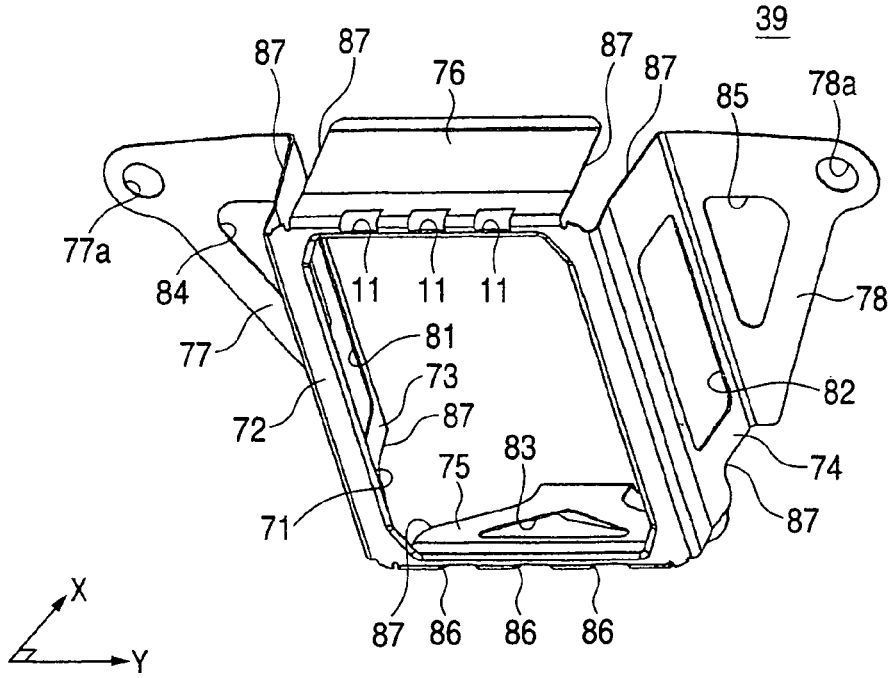
FIG. 10 is a schematic perspective view of the head cover 39 of FIG. 6.
Figure 11:
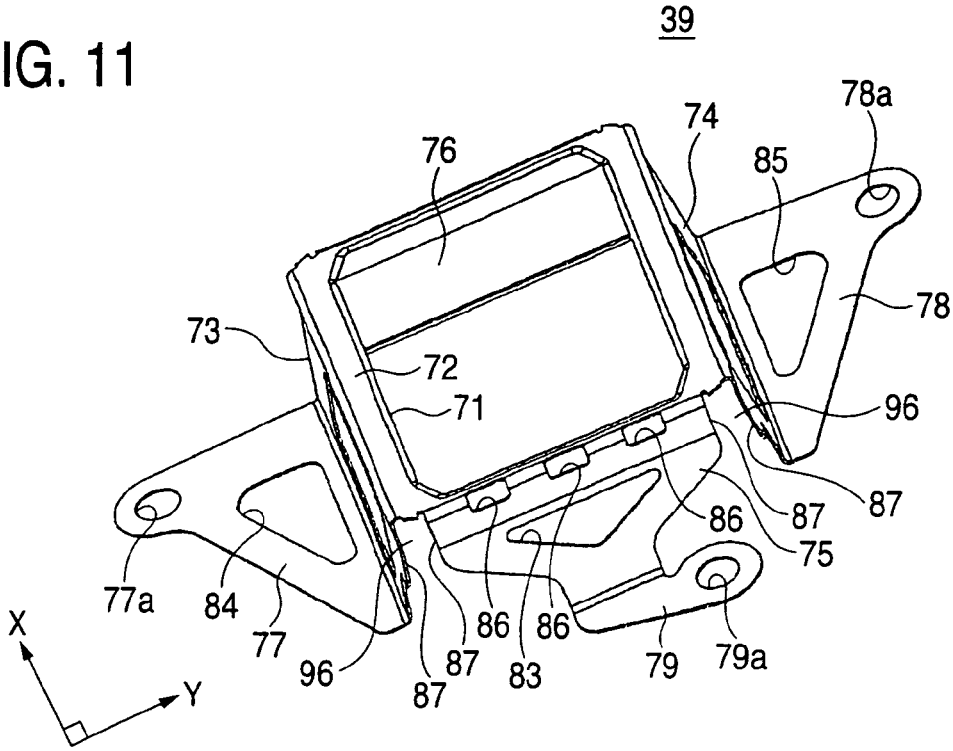
FIG. 11 is a schematic perspective view of the head cover 39 of FIG. 6.
Figure 12:
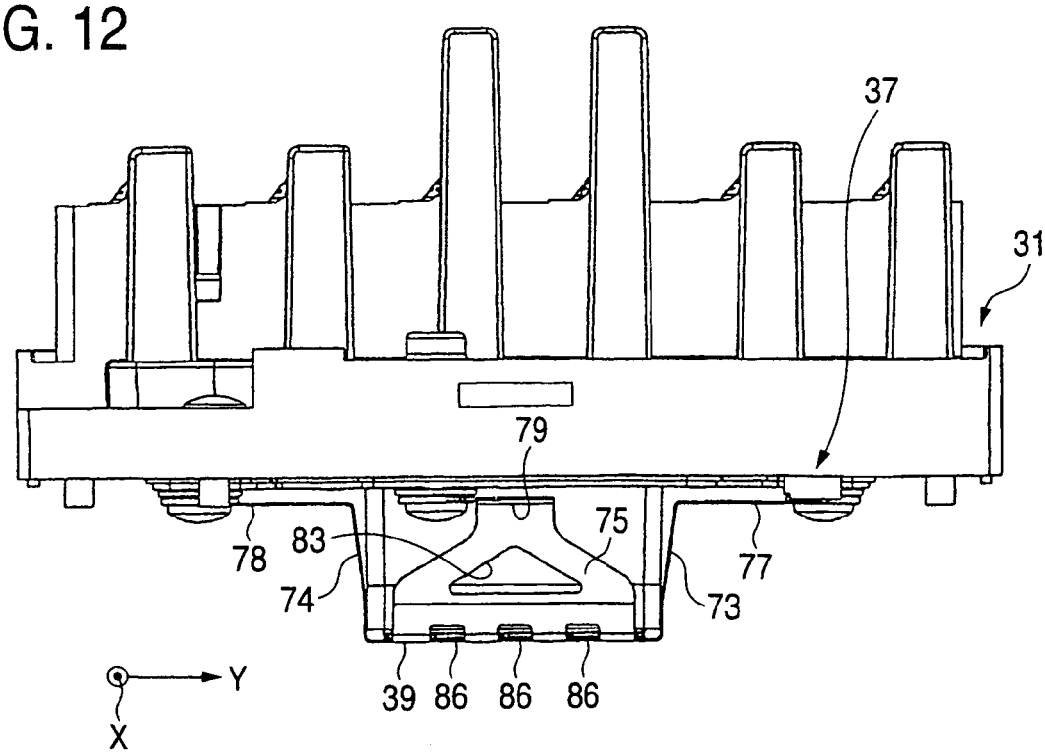
FIG. 12 is a schematic sectional view showing a behavior of attaching the head cover 39 of FIG. 9 to the head case 37 and fixing the head case 37 to a base 31.
Figure 13:
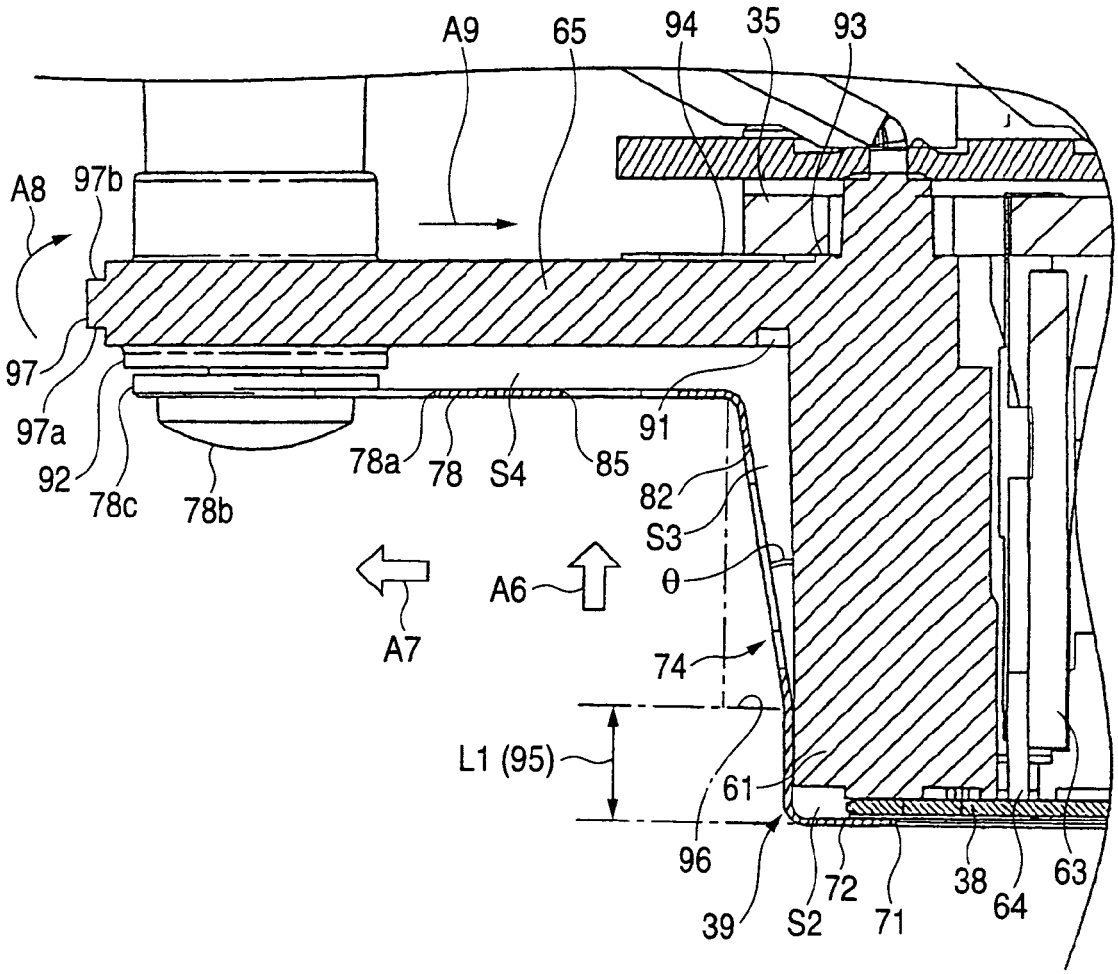
FIG. 13 is a view showing to enlarge a portion of FIG. 12.

FIG. 9 through FIG. 11 are perspective views viewing the head cover 39 respectively from different angles, FIG. 12 is a schematic sectional view showing a behavior of attaching the head cover 39 to the head case 37 and fixing the head case 37 to the base 31 and FIG. 13 is a view showing to enlarge a portion of FIG. 12.

A preferable embodiment of the head cover 39 will be explained in reference to the drawings.

Further, in FIG. 9 through FIG. 11, with respect to directions designated by notations X and Y, the direction of the arrow A4 of FIG. 1 is designated by notation Y as the main scanning direction when the recording head 30 is formed by fixing the head cover 39 to the head case 37 in a state in which the recording head 30 is integrated to the recording apparatus 100 of FIG. 1 and a direction orthogonal to the main scanning direction is designated by arrow X as the sub scanning direction.

The head cover 39 is integrally formed by a conductive metal, preferably, having properties of being difficult to rust, being rigid even by thinning a plate thickness thereof and being excellent in conductivity, specifically, for example, by stainless steel.

As shown by FIG. 5 and FIG. 12, the head case 37 is provided with a first opening portion 71 as an opening portion which does not close the nozzle opening 41*a* formed at a nozzle face which is one face of the nozzle plate 41 of the flow path unit 38 in a state of being fixed to the head cover 39. Further, the head case 37 is provided with a frame portion 72 made of the above-described metal to surround the first opening portion.

In the illustrated case, the frame portion 72 is formed in a shape of a frame in a rectangular shape according to the embodiment although the shape is not limited to the illustrated mode but may be a shape of a circular shape, a polygonal shape, an elliptical shape, an oval shape or the like so far as the shape matches to the shape of the front end portion 61 in a block-like shape of the head case 37.

There are provided protective wall portions bent substantially by 90 degrees and extended integrally from the frame portion 72. The protective wall portions are for covering to protect side faces of the front end portion 61 of the head case 37 and are divided by a plural number in accordance with a mode of the side face of the front end portion 61 of the head case 37. According to the embodiment, the frame portion 72 is constituted by a quadrangular shape and therefore, a plurality of protective wall portions 73, 74, 75 and 76 are respectively formed from four sides thereof in a mode of being partitioned respectively.

According to the embodiment, contiguous sides 87, 87 of the protective wall portions respectively contiguous to each other in the respective protective wall portions 73, 74, 75 and 75 are chamfered. That is, the respective sides 87 are chamfered by being inclined to narrow widths of the respective protective wall portions along a direction of being apart from the frame portion 72.

Thereby, ink as a remaining liquid brought to an inner side of the head cover 39 is prevented from aggregating to portions of four corners of the head cover 39 after cleaning operation, mentioned later.

A total or a portion of the protective wall portions of the head cover 39, in this case, for example, the protective wall portions 73, 74 and 75 are respectively formed integrally with support portions 77, 78 and 79 in a flange-like shape constituted by being bent substantially by 90 degrees and extended.

The respective support portions 77, 78 and 79 are utilized when the head cover 39 is attached to the head case 37. Although in attaching and fixing the support portions to the head case 37, for example, a method of screwing, thermal calking or the like can be adopted, according to the embodiment, screwing is used and the respective support portions 77, 78 and 79 are provided with screw holes 77*a*, 78*a* and 79*a*.

The respective support portions 77, 78 and 79 are chamfered preferably in a mode continuous to chamfered shapes on the contiguous sides 87, 87 of the protective wall portions.

Further, a total or a portion of the protective wall portions of the head cover 39, in this case, for example, the protective wall portion 73, 74 and 75 are formed with second opening portions 81, 82 and 83 of the head cover. The second opening portions 81, 82 and 83 are formed in consideration of positions and sizes which do not deteriorate a function of protecting the front end portion 61 of the head case 37 or the like and strength of the protective wall portions.

Similarly, a total or a portion of the support portions of the head cover 39, in this case, for example, the support portions 77 and 78 are formed with third opening portions 84 and 85 of the head cover 39. The second opening portions 84 and 85 are formed in consideration of positions and sizes which do not deteriorate a function for fixing the support portions 77 and 78 formed therewith to the head case 37 or the like and strength thereof.

Further, a notch portion is formed by selecting a portion at which ink is liable to be stored on the inner side of the head cover 39 after the cleaning operation of the recording apparatus 100, for example, a vicinity of a boundary of the frame portion 72 of the head cover 39 and the protective wall portion. The notch portion is formed at an opening penetrating the head cover 39 to enable to pass ink. A single or a plurality of the notch portions are formed.

There is no restriction in a number of the notch portions and the notch portions may be formed at anywhere so far as ink is liable to be stored on the inner side of the head cover 39. However, according to the embodiment, three opening portions 86, 86, 86 are provided at a boundary between the frame portion 72 and the protective wall portion 75 and three opening portions 11, 11, 11 are provided at a boundary between the frame portion 72 and the protective wall portion 76.

Figure 26:
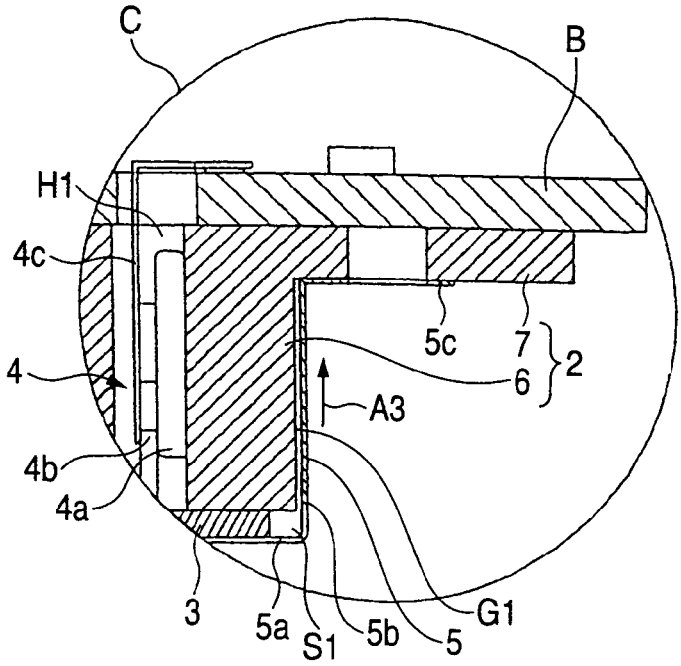
FIG. 26 is an enlarged view of a portion designated by notation C of FIG. 25.
Figure 27:
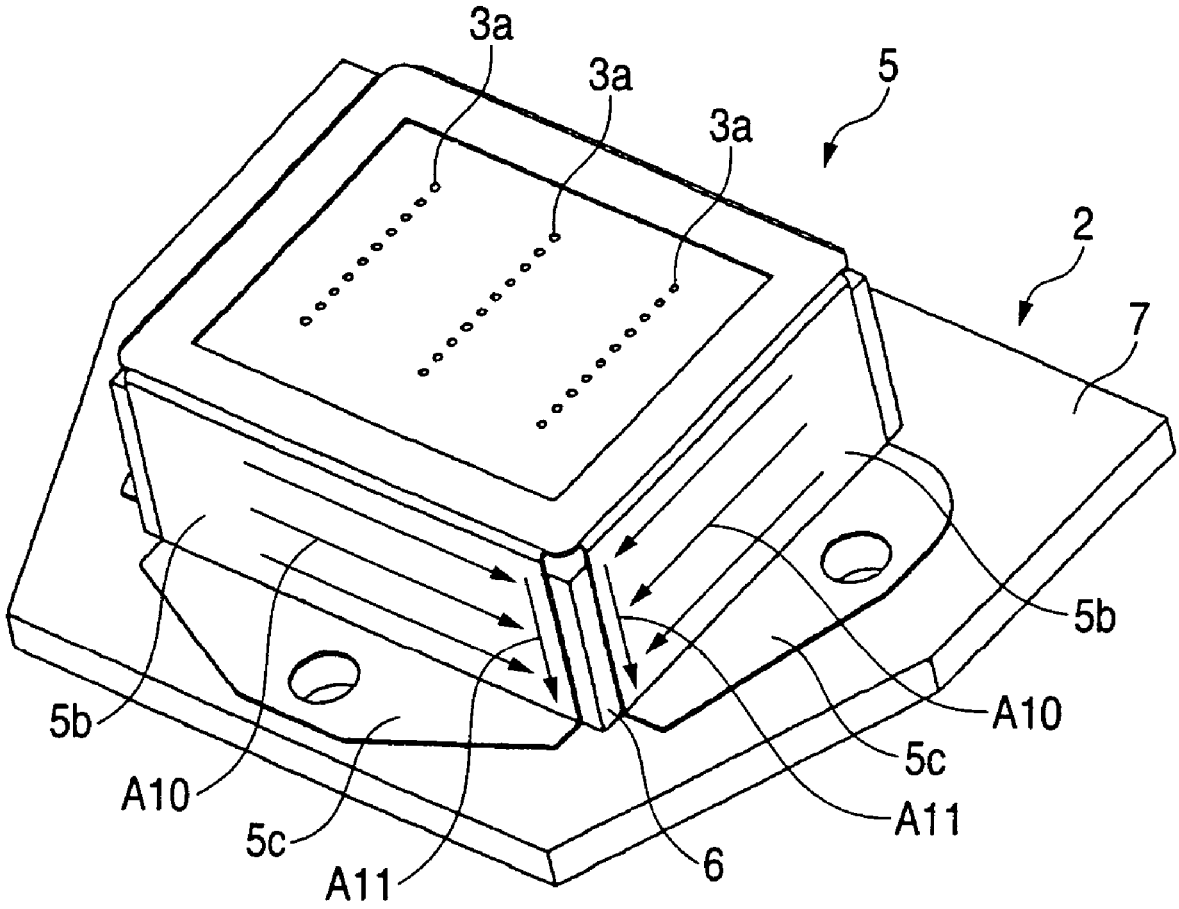
FIG. 27 is an explanatory view showing flow of ink in a state of attaching the head cover 5 to the head case 7.

The opening portions are formed to prevent ink from being stored at a space S2 of FIG. 13 which is substantially the same as the space S1 on the inner side of the head cover explained in reference to FIG. 26 as less as possible. Further, an explanation will be given of a point that the opening portions are formed by selecting respective positions at the boundary between the frame portion 72 and the protective wall portion 75 and the boundary between the frame portion 72 and the protective wall portion 76 particularly in the embodiment.

Figure 25:
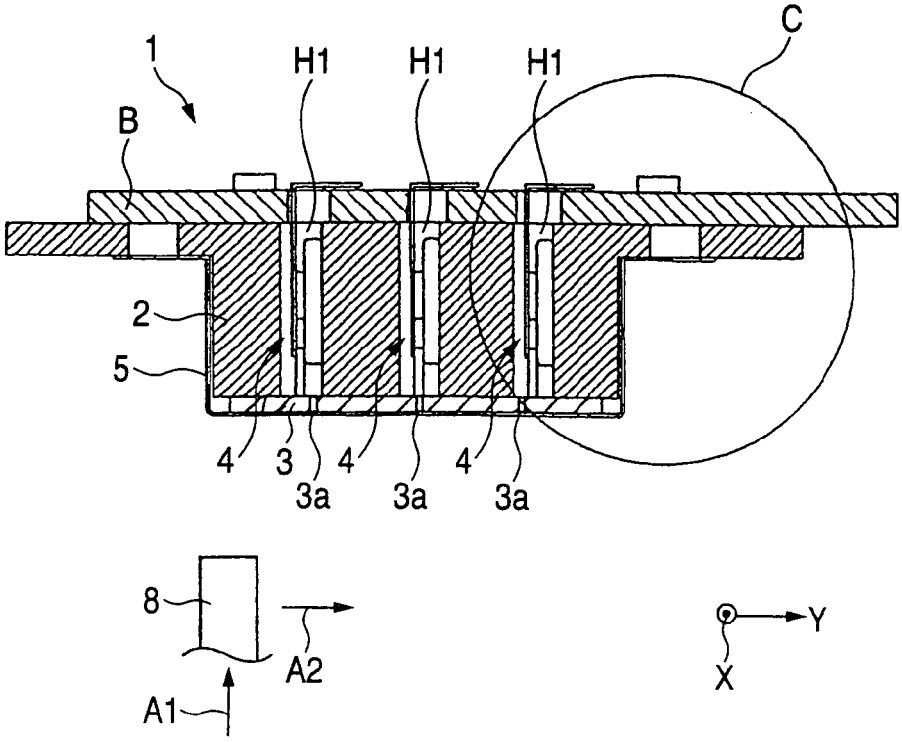
FIG. 25 is a schematic sectional view showing a portion of a recording head.

Cleaning operation in the recording head 30 of the embodiment is similar to that explained in reference to FIG. 25 and according to the embodiment, a consideration is given to the fact that the wiping device 107 shown in FIG. 1 is relatively moved in the arrow Y direction of FIG. 10.

That is, for example, in FIG. 10, when the notch portions are formed at respective positions of a boundary between the frame portion 72 and the protective wall portion 73 and/or a boundary between the frame portion 72 and the protective wall portion 74, the wiping device 107 moving in the arrow Y direction is brought into contact with the notch portions. In this case, since the wiping device 107 is formed by a comparatively soft material, when the wiping device 107 are repeatedly brought into contact with the notch portions of the head cover 39 made of a metal, the function of the wiping device 107 is deteriorated by being damaged thereby.

Therefore, according to the embodiment, the notch portions are formed by selecting the respective positions of the boundary between the frame portion 72 and the protective wall portion 75 and the boundary between the frame portion 72 and the protective wall portion 76 as positions which do not interfere with the wiping direction Y of the wiping device 107 in the cleaning operation.

Further, in order to prevent ink from being stored at a space on the inner side of the head cover 39, it is preferable to enlarge the notch portion to enlarge an opening area thereof. In this respect, for example, in FIG. 10, the notch portions 11, 11, 11 formed at the boundary between the frame portion 72 and the protective wall portion 76 can be formed by a single notch portion comprising a single large opening. However, when the notch portion is constituted by the single large opening in this way, the strength of the head cover 39 may be deteriorated. Therefore, it is preferable to construct the notch portions by a constitution of enlarging a total opening area as a plurality of divided notch portions and it is preferable to constitute a total opening area by about 50 per cent of an area of a total of the boundary when the notch portions are not formed.

Further, when possible, it is further preferable to select a boundary between a protective wall portion which is not provided with the support portion and the frame portion 72 as in the protective wall portion 76 in addition to selecting the position which does not interfere with the wiping direction of the wiping device 107, mentioned above.

Because a notch portion having an effective area or size can be provided without deteriorating strength of fixing the head cover 39 to the head case 37 by providing the notch portion as the boundary between the protective wall portion which is not provided with the support portion and the frame portion.

Here, although the cleaning operation is similar to that explained in reference to FIG. 25, according to the embodiment, the wiping device 107 shown in FIG. 1 is not provided at a location between the frame portion 72 and the protective wall portion 73 or between the frame portion 72 and the protective wall portion 74 in consideration of the fact that the wiping device 107 shown in FIG. 1 is relatively moved in a right direction or in a left direction of an arrow A5 of FIG. 10. When the notch portion is provided at such a location, there is a concern of bringing the wiping device 107 formed by a comparatively soft material into contact with the notch portion to damage. Therefore, it is preferable to form the notch portion by selecting a location which is not brought into contact with the wiping device 107 in the cleaning operation. Further, when the notch portion is provided, the notch portion can be utilized also in positioning with the cover member 109 of FIG. 1.

A further detailed constitution of the head cover 39 will be explained in reference to FIG. 13.

In FIG. 13, there is shown a specific example having a constitution in which a width of the protective portion is enlarged to the side of the support portion. Although in the drawing, for convenience of showing in details, only the mode of the protective wall portion 74 is shown, the respective wall portions 73, 75 and 76 shown in FIG. 9 through FIG. 11 are provided with similar modes. Further, the protective wall portions opposed to each other are constituted by a symmetrical mode.

In FIG. 13, the protective wall portion 74 and the protective wall portion 73 opposed thereto are constituted by a gradually opened mode to constitute a taper shape, forming clearance widening portion respectively. In FIG. 13, the mode is shown as a portion opening to an upper side by being inclined by angle θ to the left. Thereby, a clearance S3 between a side face of the front end portion 61 of the head case 37 and the protective wall portion 74 of the head cover 39 is gradually enlarged in an upper direction.

Further, preferably, a taper portion of the protective wall portion 74 is brought into close contact with the front end portion 61 of the head case 37 to constitute a positioning portion 95 at a location of the taper portion of the protective wall portion 74 by a predetermined distance from the frame portion 72, for example, starting from a distance of L1, at a location apart from the frame portion 72 of the protective wall portion 74 by the distance L1. That is, by bringing the protective wall portion of the head cover 39 into close contact with the side face of the front end portion 61 of the head case 37 by an amount of the distance of L1, positioning in attaching the head cover 39 is facilitated and the operability is promoted.

Further, in place of the above-described taper structure of the protective wall portion 74, for example, as shown by a chain line in FIG. 13, a stepped portion 96 may be formed and a portion upward from the stepped portion 96 in the drawing may be enlarged to a predetermined width.

Further, a characteristic structure of the side of the head case 37 shown in FIG. 13 will be explained.

At a portion in correspondence with the portion of fixing the base portion 65 of the head case 37 and the support portion 78, there is formed a projected portion or a projection or a boss 92 projected to the support portion 78 of the head cover 39.

Specifically, when the support portion 78 of the head cover 39 is fixed by using a screw 78*b*, the support portion 78 is made to function as a spacer interposed between a washer 78*c* and the projected portion 92. Thereby, the base portion 65 of the head case 37 and the support portion 78 of the head cover 39 are not brought into close contact with each other and a clearance S4 is opened therebetween. Further, an outer periphery of the base portion 65 is provided with a projection 97 projected slightly in an outer direction and an upward stepped portion 97*b* and a downward stepped portion 97*a* are formed respectively in an up and down direction to interpose the projection 97.

Further, a groove portion 91 is formed at a location between the front end portion 61 and the base portion 65 of the head case 37 to surround an outer periphery of the front end portion 61.

Further, in FIG. 13, a clearance 94 is formed between the upper face of the base portion 65 of the head case 37 and the circuit board 35 attached above the head case 37 by providing a support portion 93.

The embodiment is constituted as described above and a characteristic operation thereof will be explained centering on the head cover 39 as follows.

According to the recording apparatus 100, at portions of the head case 37 and the head cover 39 constituting a front end portion of the recording head 30, the wiping device 107 is relatively moved in the arrow Y direction of FIG. 12 by the above-described cleaning operation.

After the cleaning operation, a portion of wiped ink is brought from the first opening portion 71 of the head cover 39 to an inner side and is going to be stored at inside of the space S2 of FIG. 13. However, according to the embodiment, by forming the notch portions 11, 11, 11 and 86, 86, 86 at the head cover 39, ink invading the inner side of the head cover 39 is guided again from the notch portions to outside and therefore, an amount of ink staying at the inner side of the head cover 39 is significantly reduced.

However, when a space between the side face of the front end portion 61 of the head case 37 and the head cover 39 is narrow, ink still invading the inside of the head cover 39 is going to advance at inside of the clearance S3 along a direction of an arrow A6 of FIG. 13 by the capillary phenomenon. In the advancing direction of ink, that is, in the direction of the support portion 78, other parts, for example, the circuit board 35 and the like are present, which is not preferable.

Hence, according to the embodiment, first, as shown by FIG. 13, the width of the protective wall portion 74 is widened in the upward direction. That is, the clearance S3 is increased by being opened in the taper shape. Therefore, the capillary phenomenon is not operated and ink is made to be difficult to move in the direction of the arrow A6 at a location at which the clearance S3 is increased to some degree.

Here, it is preferable that the opening angle θ of the width widening potion in the taper shape is set to fall in a range from 7 degrees through 10 degrees.

When the opening angle θ of the clearance widening portion in the taper shape of the protective wall portion of the head cover 39 as less than 7 degrees, there is drawback that the capillary force is exerted to a liquid of ink or the like invading between the head cover and the head case. Further, when the opening degree of the clearance widening portion in the taper shape of the head cover exceeds 10 degrees, there is a drawback of enlarging the head. When the opening degree of the clearance widening portion in the taper shape of the head cover falls in a range of from 7 degrees through 10 degrees, there is achieved an advantage of capable of preventing the capillary force from exerting to the liquid of ink or the like invading between the head cover and the head case without enlarging the head.

Further, since the protective wall portion 74 is provided with the second opening portion 82, an area of forming the clearance S3 as a space between the side face of the front end portion 61 of the head case 37 and the head cover 39 is reduced and a portion at which a clearance of holding the liquid is present is reduced by that amount and therefore, ink is made to be difficult to move in the direction of the arrow A6 also in this respect.

However, when ink still reaches a vicinity of the base portion 65 of the head case 37, ink is stored by the groove portion 91. Therefore, ink is prevented from advancing at the clearance S4 between the base portion 65 and the support portion 78 along a horizontal direction of FIG. 13 so far as a storage limit of the groove portion 91 is not exceeded.

Further, according to the embodiment, since the projected portion 92 of the base portion 65 serves as the spacer enlarging the clearance S4 between the base portion 65 and the support portion 78, the clearance S4 is increased. Therefore, the capillary phenomenon is not operated and ink is made to be difficult to move in a direction of an arrow A7.

Further, since the support portion 78 is provided with the third opening portion 85, an area of forming the clearance S4 between the base portion 65 and the support portion 78 is reduced, a portion at which an interval of holding the liquid is present is reduced and therefore, ink is made to be difficult to move in the direction of the arrow A7 also in this respect.

Further, when there is ink reaching a vicinity of the outer periphery of the base portion 65, ink is stored at the downward stepped portion 97*a* on the lower side of the projection 97 and when ink exceeding a storage limit thereof is turned around in an arrow A8 direction, ink is stored at the upward stepped portion 97*b*. When ink exceeding a storage limit of the upward stepped portion 97*b* is moved in a direction of arrow A9, generation of the capillary force is prevented between the support potion 93 and the circuit board 35 by the clearance 94 to thereby prevent ink from invading an electric connection portion.

In this way, according to the embodiment, by providing the notch portions 11, 11, 11 and 86, 86, 86 at the head cover 39, ink is effectively prevented from being stored at the space A2 on the inner side of the head cover 39. In addition thereto, even when there is ink invading the inner side of the head cover 39, by eliminating the clearance at which the capillary phenomenon is liable to be operated between the head cover 39 and the head case 37, ink can be prevented from invading the circuit board 35 or the like by preventing ink from being brought to and held by the clearance and preventing a large amount of ink from being stored in the clearance over a wide area.

Particularly, a large amount of ink can be prevented from being stored in a range reaching the support portion 78 from the frame portion 72 of the head cover 39 and when the attitude of the recording head 30 is changed in carrying the recording apparatus 100 by the user or the like, there can effectively be avoided a concern of bringing about electric shortcircuit or hampering the function by invasion of ink stored by a large amount to other part of the circuit board 35 or the like.

FIG. 14 through FIG. 17 are views showing a modified example of the head cover 39 according to the embodiment.

Figure 14:
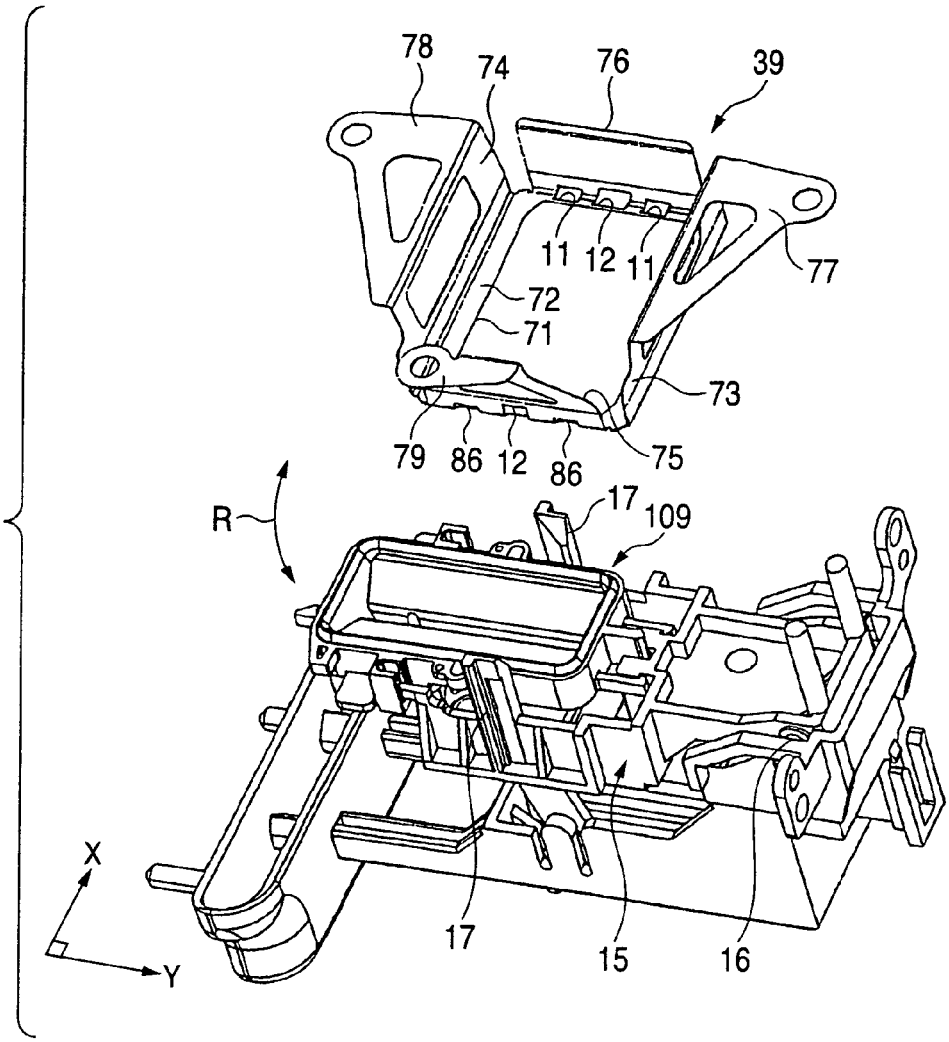
FIG. 14 is a perspective view specifically showing a structure of a surrounding of a covering device 109 of FIG. 1.

FIG. 14 is a perspective view specifically showing a structure of a surrounding of the covering device 109 explained in reference to FIG. 1.

In the drawing, the cover member (cap) 109 is fixed to a slider 15 moved by following the movement of the carriage 101 of FIG. 1 in the arrow Y direction. The slider 15 is moved up and dow along a locus substantially in a shape of a circular arc as shown by an arrow R by following the movement of the carriage 101 in the arrow Y direction by being supported by a support shaft 16. That is, when the carriage 101 is moved to the home position (nonprinting region), the slider 15 is moved in the upward direction of the arrow R to cover the nozzle face of the recording head 30 fixed with the head cover 39 shown by FIG. 14.

Here, the slider 15 is provided with guide members 17, 17 each in a shape of a stay provided to erect vertically on both sides in the width direction of the covering member 109. Therefore, also the guide members 17, 17 are moved up and down similar to the covering member 109 in accordance with the movement of the slider 15. The guide members 17, 17 are for guiding the covering member 109 to correctly position to the nozzle face of the recording head 30 to cover.

Although the head cover 39 of FIG. 14 is formed with notch portions explained in reference to FIG. 9 through FIG. 11, according to the modified example, a portion of a plurality of notch portions is constituted by a mode different from that of FIG. 11.

Figure 15:
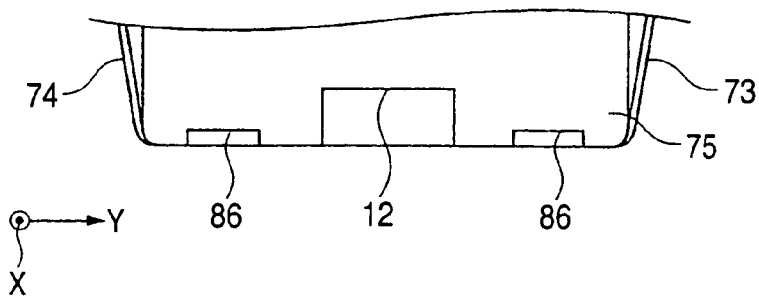
FIG. 15 is a partially enlarged view showing a constitution of a modified example of the head cover of FIG. 9.

FIG. 15 shows three notch portions 86, 12, 86 provided at the boundary between the protective wall portion 75 and the frame portion 72 of the head cover 39. According to the modified example, among the plurality of notch portions, for example, a single notch portion 12 at center thereof is made so as to be disposed at a position the same as that of one of the guide members 17, 17 of FIG. 14, when the recording head 30 is covered by the covering member 109. Further, as illustrated, the notch portion is made to constitute guiding device by being notched up to a position higher than those of the other notch portions 86, 86.

Similarly, also the three notch portions provided at the boundary between the protective wall portion 76 and the frame portion 72 of the head cover 39 are constructed by a similar constitution.

Figure 16:
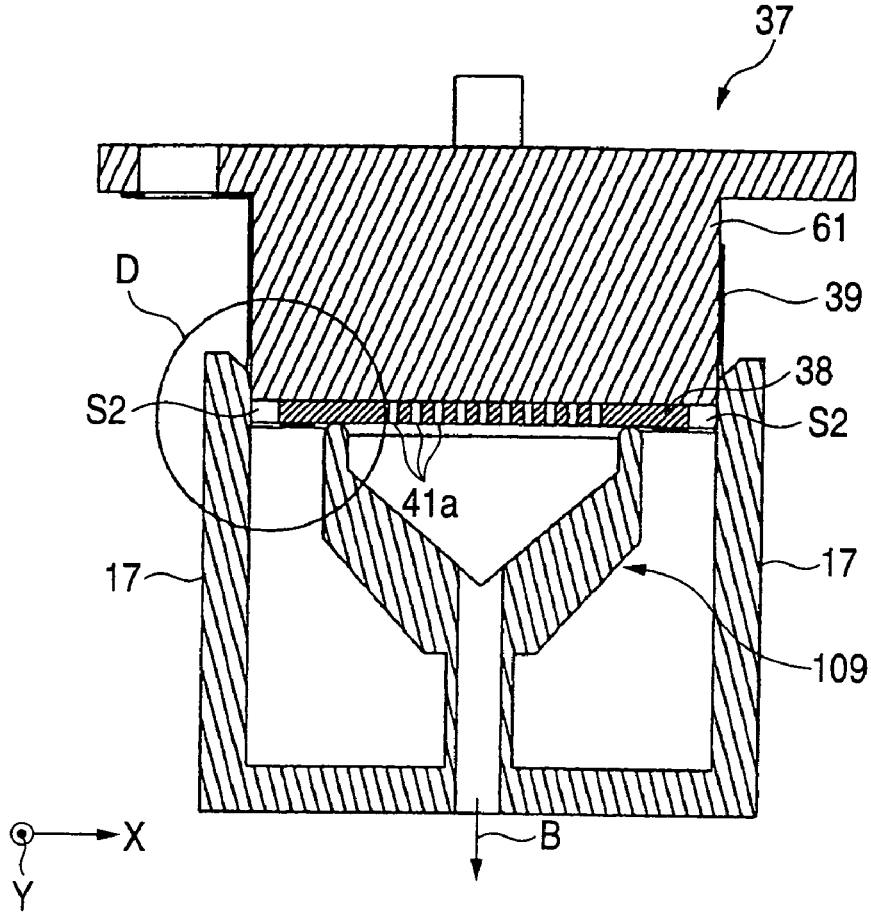
FIG. 16 is a schematic sectional view showing a state of covering a lower face of the flow path unit 38 which is a nozzle face of the recording head 30 by a covering member 109 of FIG. 1.
Figure 17:
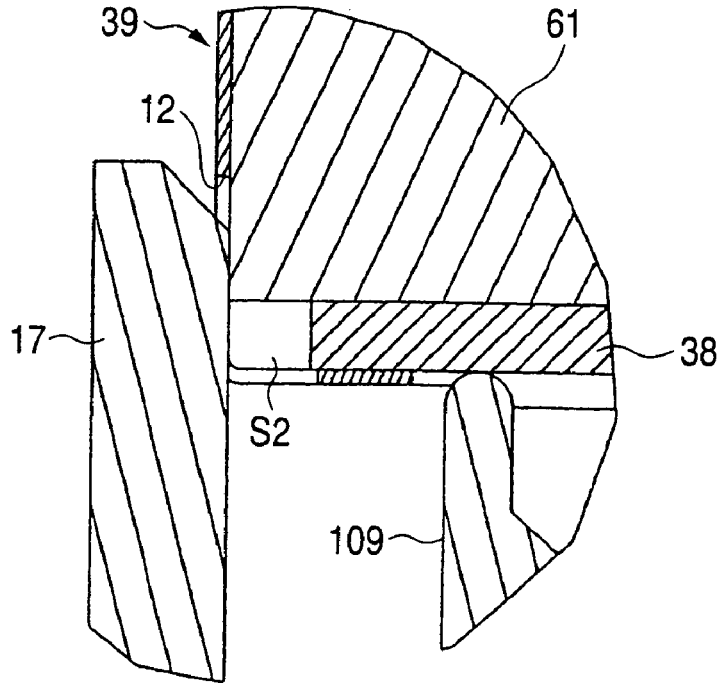
FIG. 17 is an enlarged view of a portion of notation D of FIG. 16.

FIG. 16 is a schematic sectional view showing a state in which the covering member 109 covers a lower face of the flow path unit 38 which is the nozzle face of the recording head 30 and FIG. 17 is an explanatory view showing to enlarge a portion of FIG. 16 designated by notation D.

As shown by FIG. 17, when the guide member 17 is fitted to the notch portion 12 as the guiding device, the flow path unit is positioned and can be brought into contact therewith without interposing the head case 37 and the head cover 39 to be adhered to each other and the covering member 109 provided at the slider 15 can accurately cover the nozzle face of the lower face of the flow path unit 38.

Clogging of ink or the like of the nozzle face can be cleaned by vacuuming the covering member 109 as shown by an arrow B under the state as shown by FIG. 16.

In this way, in the case of the modified example, the notch portion can not only prevent a liquid of ink or the like from being stored at the inner side of the head cover 39 but can function as a guiding device in mounting the covering member which needs accurate positioning.

Figure 18:
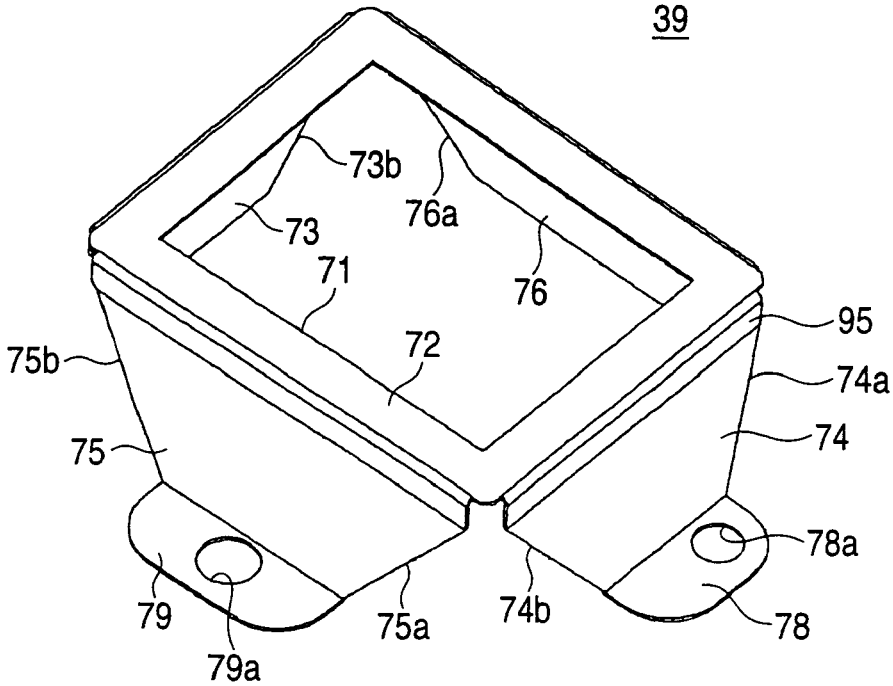
FIG. 18 is a schematic perspective view of the head cover 39 according to other embodiment of ahead cover of the invention.
Figure 19:
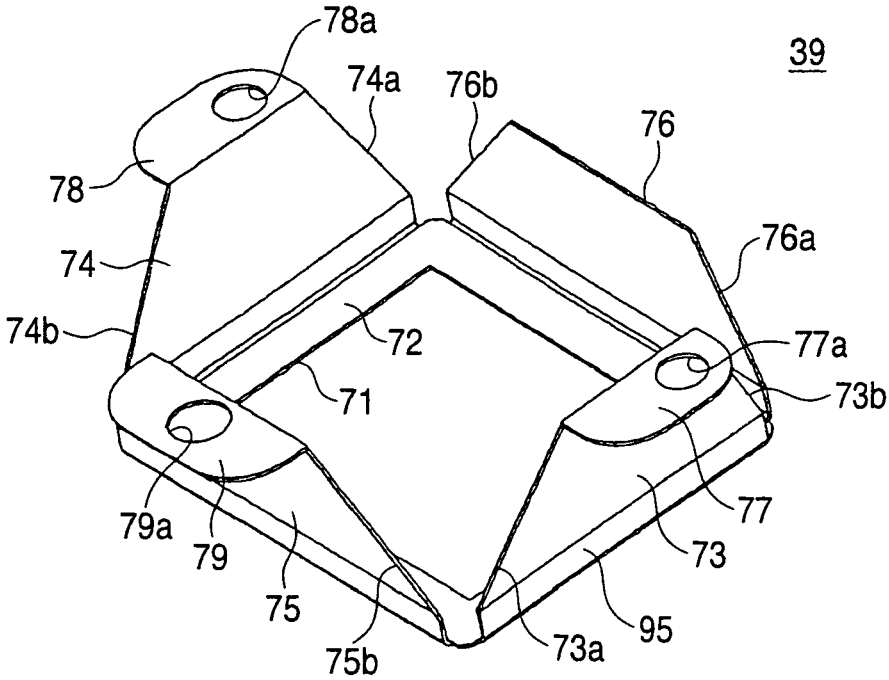
FIG. 19 is a schematic perspective view of the head cover 39 according to other embodiment of ahead cover of the invention.
Figure 20:
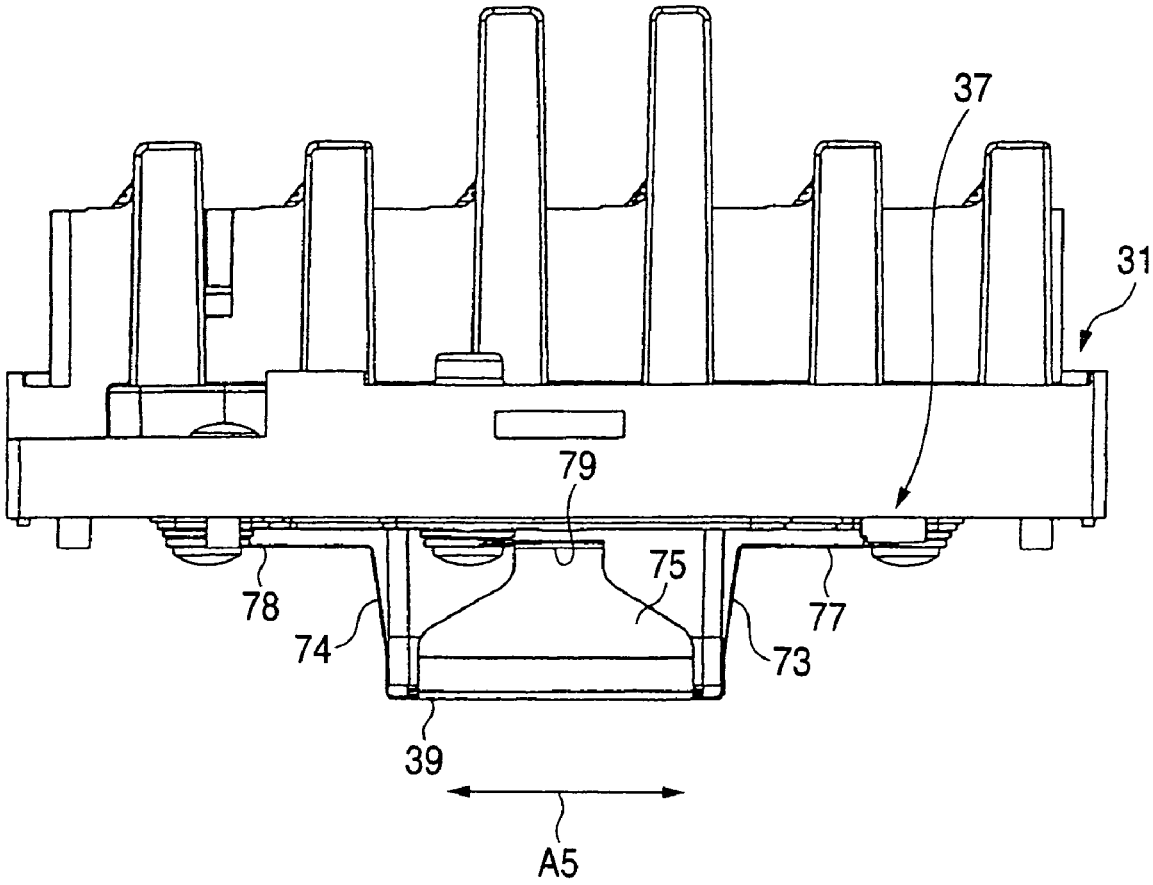
FIG. 20 is a schematic sectional view showing a behavior of attaching the head cover 39 of FIG. 9 to the head case 37 and the fixing the head case 37 to the base 31.
Figure 21:
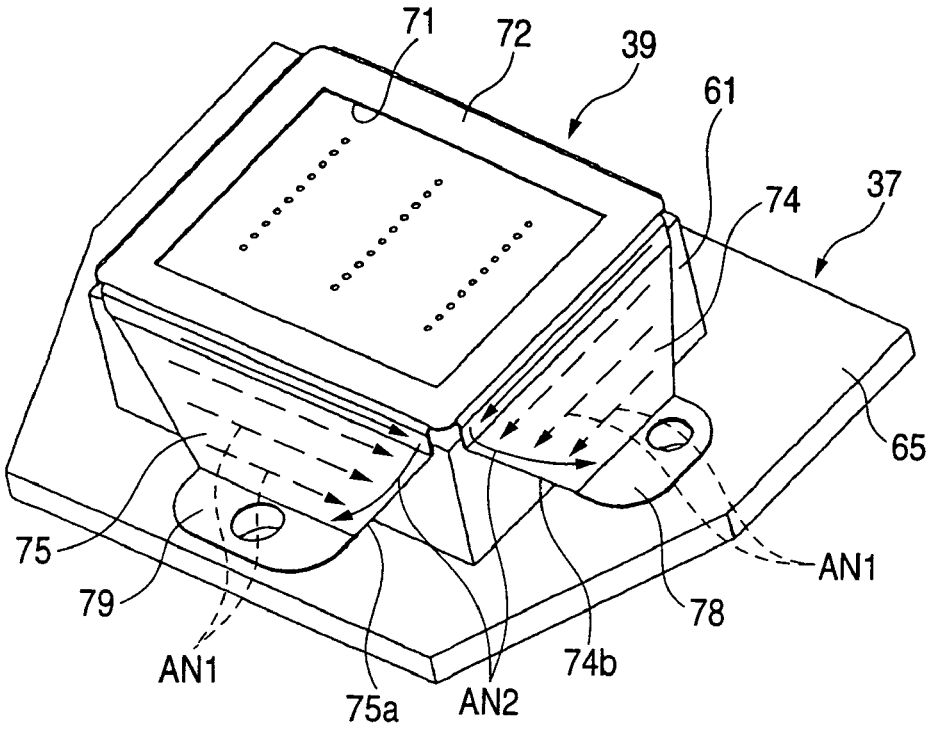
FIG. 21 is an explanatory view showing flow of ink in a state of attaching the head cover 39 to the head case 37.

FIG. 18 and FIG. 19 show other embodiment of the head cover used in the embodiment. The drawings are perspective views viewing the head cover according to the other embodiment from angles different from each other, FIG. 18 is a schematic perspective viewing the head cover 39 from a top side and FIG. 19 is a schematic perspective view viewing the head cover 39 from a back side. FIG. 20 is a schematic sectional view showing a behavior of attaching the head cover 39 to the head case 37 and fixing the head case 37 to the base 31 and FIG. 21 is an explanatory view showing flow of ink in a state in which the head cover 39 is attached to the head case 37.

Further, FIG. 18 and FIG. 19 are views for explaining characteristics of the head cover 39 and although a shape of the head cover 39 slightly differs from the head cover 39 of tie above-described embodiment of FIG. 5 and FIG. 6, the basic structure stays the same.

Corresponding members in the respective embodiments are attached with the same reference numerals and an explanation thereof will be omitted.

According to the embodiment, among the respective protective wall portions 73, 74, 75 and 76, contiguous end faces of the protective wall portions contiguous to each other are chamfered. According to the embodiment, the contiguous end faces of all of the protective wall portions are constituted by the same shape and therefore, an explanation will be given of contiguous end faces of the protective wall portions 73 and 75 contiguous to each other in reference to FIG. 19.

That is, the respective end faces are formed with chamfered portions 73*a* and 75*b*. According to the respective chamfered portions 73*a* and 75*b*, end faces or sides of the protective wall portions formed therewith are chamfered to be inclined to narrow widths of the respective protective wall portions 73 and 75 along a direction of being apart from the frame portion 72.

Thereby, as mentioned later, after the cleaning operation, ink as a remaining liquid brought to the inner side of the head cover 39 is made to be prevented from aggregating to locations of four corners of the head cover 39.

The respective support portions 77, 78 and 79 are preferably chamfered in a mode continuous to chamfered shape to the contiguous end faces of the protective wall portions.

Here, the shape of the chamfered portion is not limited to shapes illustrated as the chamfered portions 73*a* and 75*b*. For example, the chamfered portion may not be chamfered up to a predetermined distance from the frame portion 72 but may be chamfered from a middle thereof. Further, the chamfered shape may be a curved shape or a linear shape or may be constituted by a locus in a zigzag shape or in a shape of slalom.

Further, according to the head cover 39 of the embodiment, by the above-described structure, a liquid of ink or the like is made to be difficult to be stored at the clearance between the protective wall portion and the front end portion 61 of the head case 37 and ink or the like brought into the clearance is guided as shown by FIG. 21.

In the drawing, although ink or the like invading the clearances between the protective wall portions 74 and 75 and the front end portion 61 of the head case 37 is held at the inner faces of the respective protective wall portions 74 and 75, when the contiguous portions of the respective protective wall portions 74 and 75 are inclined in the lower direction, ink at the inner faces of the respective protective wall portions 74 and 75 falls down to the contiguous portions of the respective protective wall portions 74 and 75 by its own weight as shown by arrows AN1, AN1.

However, in FIG. 21, at the contiguous end faces of the protective wall portion 74 and 75, the chamfered portions 74*b* and 75*a* are provided and therefore, ink at the inner faces of the respective protective wall portions 74 and 75 advances in directions of arrows AN2 without meeting with each other. That is, ink falls down along shapes of the end faces of the chamfered portions 74*b* and 75*a*.

That is, according to the head cover 39, there is constituted a structure in which the respective end faces of the contiguous protective wall portions 74 and 75 are not butted to each other and therefore, even when the attitude of the recording head 30 is changed, there is hardly a location of a corner at which a liquid of ink or the like is aggregated. Therefore, a large amount of ink or the like is not aggregated and is effectively prevented from advancing to other part of the circuit board 35 or the like by constituting the large amount.

Particularly, according to the embodiment, there is constructed a constitution of being fixed by screwing similar to the above-described embodiment. Further, as shown by FIG. 21, the chamfered portions 74*b* and 75*a* are formed at the contiguous end faces of the protective wall portions 74 and 75 respectively having the screwed support portions 78 and 79. Therefore, when a large amount of ink or the like is guided to concentrate on the screwed support portions 78 and 79, ink is liable to invade the side of other part via the screwed portions. Therefore, when the chamfered portions are provided at the contiguous end faces of the protective wall portions 74 and 75 having the screwed support portions 78 and 79, a large amount of ink or the like aggregated to the corners is not summarizingly guide to either of the support portions 78 and 79 but is dispersed and therefore, a liquid conducted to the screwed portion can effectively be prevented from invading the side of other part.

Further, by providing the chamfered portions 74*b* and 75*a* at the contiguous end faces of the protective wall portions 74 and 75, an area of a region formed with a clearance which is liable to hold ink or the like is reduced and a large amount of liquid of ink or the like can effectively be prevented from being aggregated also in this respect.

In this way, according to the embodiment, ink or the like is difficult to be aggregated to locations of contiguous corners of the protective wall portions of the head cover 39 and therefore, ink can be prevented from invading the circuit board 35 or the like by preventing a large amount of ink or the like from being aggregated.

Particularly, in a range reaching the support portion 78 from the frame portion 72 of the head cover 39, a large amount of ink can be prevented from being stored and when the attitude of the recording head is changed in carrying the recording apparatus 100 or the like, there can effectively be avoided a concern of bringing about electric shortcircuit or hampering the function by invasion of ink stored in a large amount to other part of the circuit board 35 or the like.

Figure 22:
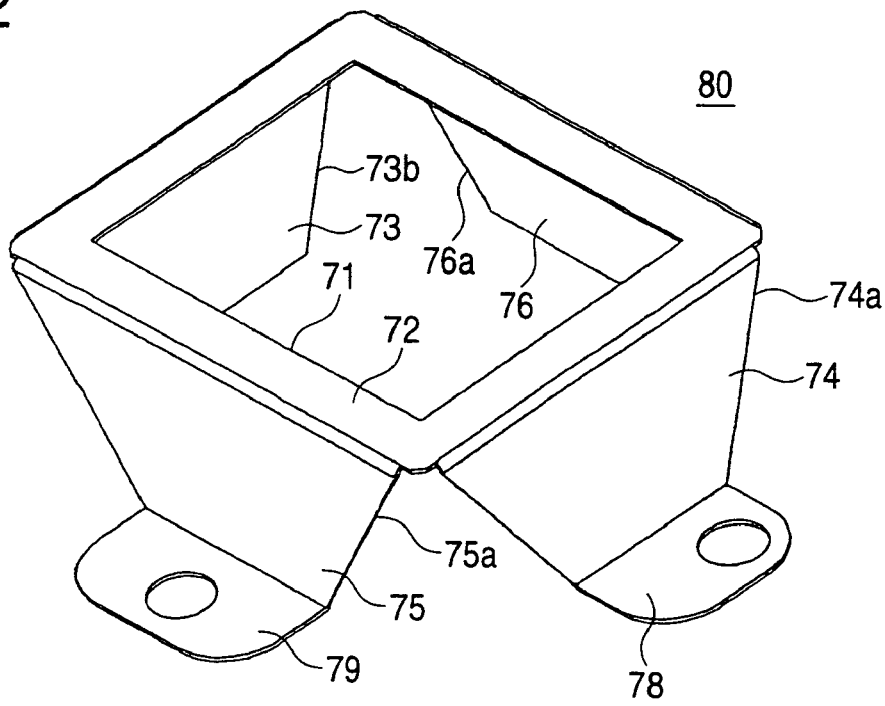
FIG. 22 is a schematic perspective view of a head cover 80 according to a modified example of other embodiment of a head cover according to the invention.
Figure 23:
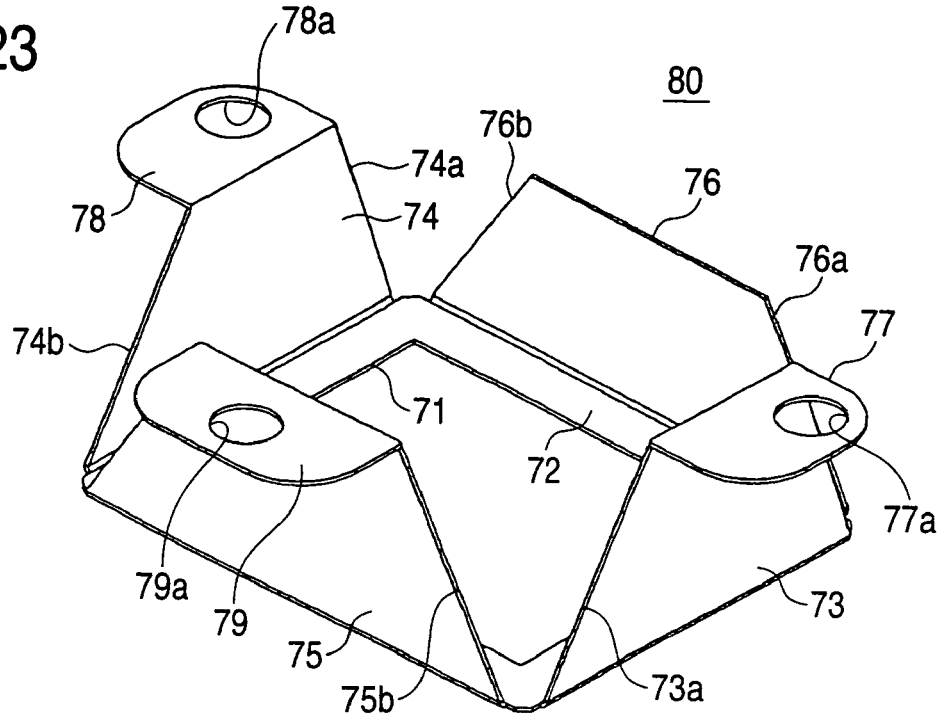
FIG. 23 is a schematic perspective view of the head cover 80 according to the modified example of the other embodiment of the head cover according to the invention.

FIG. 22 and FIG. 23 show a modified example of the second embodiment of the head cover according to the invention. In ahead cover 80 of FIG. 22 and FIG. 23, portions thereof attached with notations the same as those of FIG. 18, FIG. 19 and FIG. 20 are constructed by common constitutions and therefore, a duplicated explanation thereof will be omitted and an explanation will be given centering on a difference therebetween.

In the drawings, the head cover 80 differs from the head cover 39 in that there is not a width widening structure as in the taper shape and the stepped portion 96 explained in reference to FIG. 12 when compared with each other.

Figure 24:
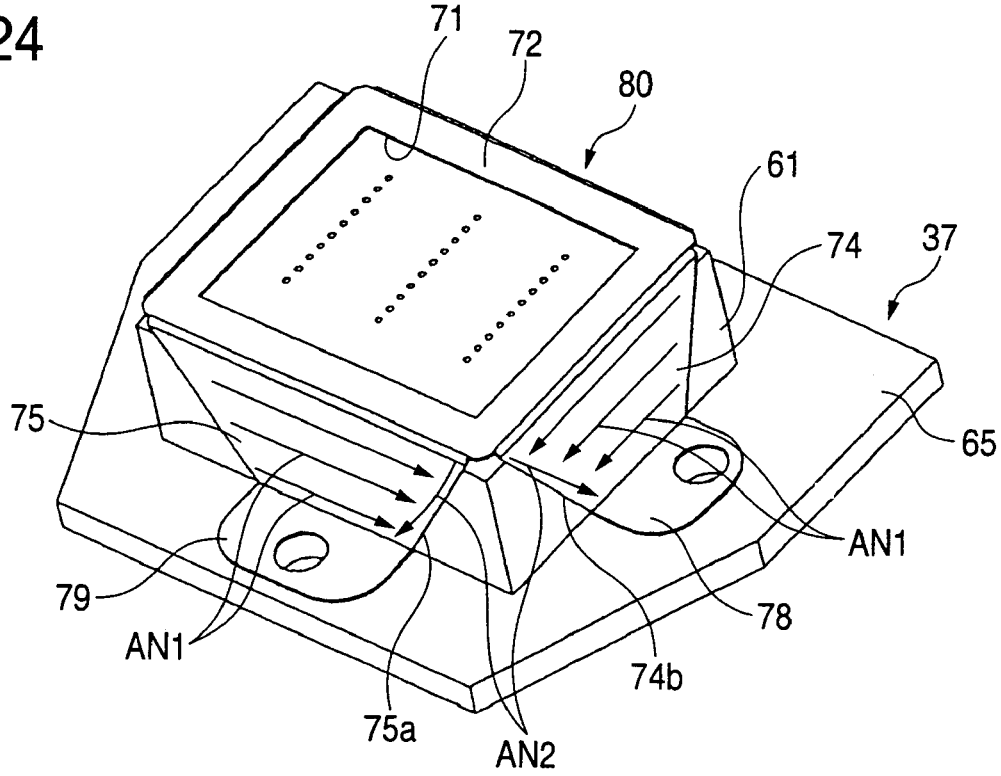
FIG. 24 is an explanatory view showing flow of ink in a state of attaching the head cover 80 to the head case 37.

FIG. 24 is an explanatory view showing a flow of ink in the state of attaching the head cover 80 to the head case 37 and when compared with the head cover 39, although the head cover 80 is inferior in that the clearance between the protective wall portion and the front end portion 61 of the head case 37 is reduced by an amount of eliminating the above-described width widening structure of the protective wall portion to facilitate to hold ink or the like, the head cover 80 is common thereto in respect of operation of guiding the flow of ink.

Therefore, the head cover 80 of the modified example can achieve operation and effect common to those of the head cover 39.

Meanwhile, the invention is not limited to the above-described embodiments.

Although the above-described embodiments is the most preferable embodiments combined with various preferable constitutions, the range of the invention is not limited to the embodiments but, for example, as the constitution of the head cover 39, only structure of the notch portion by itself may be adopted. Further, the protective wall portions may not be divided by a plural number and in this case, a single or a plurality of notch portions may be provided at a boundary between a single protective wall portion and a frame portion.

Further, as a constitution of the head cover 39, only the taper (width widening) structure of the protective wall portion may be adopted by itself, or only the second opening portion of the protective wall portion may be adopted by itself, or only the third opening portion of the support portion may be adopted by itself. Further, each constitution of the projected portion 92, the groove portion 91 or the like of the base portion of the head case 37 may be adopted by itself without adopting these constitutions of the head cover 39.

Further, as a constitution of the head cover 39, only the chamfered structure may be adopted by itself, or the chamfered structure may partially be adopted at end faces of the plurality of protective wall portions without adopting the chamfered structure for all of the end faces of the plurality of protective wall portions.

As has been explained above, according to the invention, the liquid ejection head capable of effectively preventing a liquid from effecting adverse influence on the circuit board by preventing ink from being stored at a space on the inner side of the head cover and the liquid ejection apparatus using the liquid ejection head can be provided.

According to the invention, the liquid ejection head capable of preventing a liquid from effecting adverse influence on the circuit board by preventing a small space for introducing a liquid of ink or the like from being formed between the protective wall portion of the head cover and the side face portion of the head case and the heat ejection apparatus using the liquid ejection head can be provided.

According to the invention, the liquid ejection capable of effectively avoiding a liquid from effecting adverse influence on the circuit board by preventing a liquid of ink or the like held between the protective wall portion of the head cover and the side face portion of the head case from being aggregated between the contiguous protective wall portions and the liquid ejecting apparatus using the liquid ejection head can be provided.

What is claim is:

1. A liquid ejection head comprising:

a flow path unit including a nozzle having a nozzle opening for ejecting a liquid, and a pressure chamber communicating with the nozzle in which a pressure of the liquid is changed;

a head case on a surface of which the flow path unit is attached so that the nozzle opening is located on the surface of the head case;

a head cover attached on the head case for protecting the liquid ejection head, the head cover comprising:

an opening portion from which the nozzle face is exposed, a frame portion surrounding the opening portion and supporting a peripheral edge portion of the flow path unit so that the flow path is attached to the head case, at least one protective wall portion extending from the frame portion so as to cover a side face of the head case, and a support portion formed integrally with the protective wall portion by being bent from the protective wall portion so as to extend to a surrounding direction, the support portion is adjoined to the head case;

wherein a liquid restricting portion for restricting an invasion and/or storage of liquid between the head case and head cover is formed on the head cover, wherein a plurality of the protection wall are provided as said at least one protection wall and adjacent two walls of the four protective walls do not intersect with each other, and wherein the liquid restricting portion is provided as a structure that an end face in a direction of a width of each of the protective wall portions includes a chamfered portion chamfered so as to reduce a width of each of the protective wall portions along a direction of being apart from the frame portion.

2. The liquid ejection head according to claim 1, wherein a width of an interval between the protective wall portions opposed to each other in the plurality of protective wall portions is formed to widen toward sides of the support portions.

3. The liquid ejection head according to claim 2, wherein widths of interval widening portions of the protective wall portions opposed to each other of the head cover for widening the widths are widened by providing stepped portions at portions of the protective wall portions.

4. The liquid ejection head according to claim 1, wherein the plurality of support portions integral with the plurality of protective wall portions are constructed so as to be fixed to the head case by screwing and the chamfered portions are formed at end faces of the protective wall portions including the support portions to be screwed contiguous to each other.

5. A liquid ejection head comprising:

a flow path unit including a nozzle having a nozzle opening for ejecting a liquid, and a pressure chamber communicating with the nozzle in which a pressure of the liquid is changed;

a head case on a surface of which the flow path unit is attached so that the nozzle opening is located on the surface of the head case;

a head cover attached on the head case for protecting the liquid ejection head, the head cover comprising:

an opening portion from which the nozzle face is exposed, a frame portion surrounding the opening portion and supporting a peripheral edge portion of the flow path unit so that the flow path is attached to the head case, at least one protective wall portion extending from the frame portion so as to cover a side face of the head case, and a support portion formed integrally with the protective wall portion by being bent from the protective wall portion so as to extend to a surrounding direction, the support portion is adjoined to the head case;

wherein:

a liquid restricting portion for restricting an invasion and/or storage of liquid between the head case and head cover is formed on the head cover, a plurality of the protection wall are provided as said at least one protection wall, the liquid restricting portion is provided as a structure that an end face in a direction of a width of each of the protective wall portions includes a chamfered portion chamfered so as to reduce a width of each of the protective wall portions along a direction of being apart from the frame portion a width of an interval between the protective wall portions opposed to each other in the plurality of protective wall portions is formed to widen toward sides of the support portions, and interval widening portions of the protective wall portions opposed to each other of the head cover for widening the widths are formed in a taper shape gradually widening toward sides of the support portions.

6. The liquid ejection head according to claim 5, wherein the interval widening portion in the taper shape of the head cover is started from a location apart from the frame portion to the side of the support portion by a predetermined distance.

7. A liquid ejection apparatus comprising:

a liquid ejection head comprising:

a flow path unit including a nozzle having a nozzle opening for ejecting a liquid, and a pressure chamber communicating with the nozzle in which a pressure of the liquid is changed, a head case on a surface of which the flow path unit is attached so that the nozzle opening is located on the surface of the head case, a head cover attached on the head case for protecting the liquid ejection head; and a device for moving the liquid ejection head relative to an object of ejecting the liquid;

the head cover comprising:

an opening portion from which the nozzle face is exposed, a frame portion surrounding the opening portion and supporting a peripheral edge portion of the flow path unit so that the flow path is attached to the head case, at least one protective wall portion extending from the frame portion so as to cover a side face of the head case, and a support portion formed integrally with the protective wall portion by being bent from the protective wall portion so as to extend to a surrounding direction, the support portion is adjoined to the head case;

wherein a liquid restricting portion for restricting invasion and storage of liquid between the head case and head cover is formed on the head case, wherein a plurality of the protection wall are provided as said at least one protection wall and adjacent two walls of the four protective walls do not intersect with each other, and wherein the liquid restricting portion is provided as a structure that an end face in a direction of a width of each of the protective wall portions includes a chamfered portion chamfered so as to reduce a width of each of the protective wall portions along a direction of being apart from the frame portion.

* * * * *